US011958165B2

(12) United States Patent
Beaucamp

(10) Patent No.: US 11,958,165 B2
(45) Date of Patent: Apr. 16, 2024

(54) METHODS AND APPARATUS FOR SHAPING WORKPIECES

(71) Applicant: Zeeko Innovations Limited, Coalville (GB)

(72) Inventor: Anthony Beaucamp, Saitama (JP)

(73) Assignee: Zeeko Innovations Limited, Coalville (GB)

( * ) Notice: Subject to any disclaimer, the term of this patent is extended or adjusted under 35 U.S.C. 154(b) by 1311 days.

(21) Appl. No.: 16/469,108

(22) PCT Filed: Dec. 15, 2017

(86) PCT No.: PCT/GB2017/053773

§ 371 (c)(1),
(2) Date: Jun. 12, 2019

(87) PCT Pub. No.: WO2018/109501

PCT Pub. Date: Jun. 21, 2018

(65) Prior Publication Data

US 2020/0094374 A1 Mar. 26, 2020

(30) Foreign Application Priority Data

Dec. 16, 2016 (GB) ..... 1621699

(51) Int. Cl.
*B24B 53/017* (2012.01)
*B24B 49/12* (2006.01)
(Continued)

(52) U.S. Cl.
CPC ..... *B24B 53/017* (2013.01); *B24B 49/12* (2013.01); *B24B 51/00* (2013.01); *B24D 3/28* (2013.01);
(Continued)

(58) Field of Classification Search
CPC ..... B24B 49/12; B24B 49/02; B24B 49/04; B24B 51/00; B24B 27/0007; B24B 27/0023; B24B 27/0038; B24B 27/0015
See application file for complete search history.

(56) References Cited

U.S. PATENT DOCUMENTS 4,447,208 A 5/1984 Kawai
4,643,622 A * 2/1987 Winski ..... G05B 19/416 409/80
(Continued)

FOREIGN PATENT DOCUMENTS

CN 103862373 A * 6/2014 ..... B24B 49/04
CN 103949970 A 7/2014
(Continued)

OTHER PUBLICATIONS

ДИ, "Metal Cutting Tools", Publisher: China Machine Press, Publication date: Aug. 1985, pp. 1 through 5.
(Continued)

*Primary Examiner* — Joel D Crandall
(74) *Attorney, Agent, or Firm* — Fogg & Powers LLC

(57) ABSTRACT

Methods and apparatus for shaping workpieces are described in which data representing the surface form of the workpiece is analysed to determine characteristics of curvature of the surface, and these characteristics are used to determine the size and form required for a tool to apply shaping treatment to all parts of the workpiece surface. Measurements of the actual workpiece are then compared with data relating to the required workpiece form, to determine the amount and distribution of material to be removed from the workpiece. A tool path for moving the tool over the workpiece to achieve the required shaping operation is then determined, and the tool and tool path data are provided to a shaping machine to carry out the shaping operation. The shaping tool may comprise an elastomeric body covered in
(Continued)

a flexible cloth on which rigid pellets containing abrasive material are fixed. The specification discloses methods of manufacturing such tools, and also discloses methods for conditioning the pelleted cloth. There is also described a method of determining permissible amounts of tool offset to ensure smooth cutting of the workpiece.

12 Claims, 19 Drawing Sheets

(51) Int. Cl.
*B24B 51/00* (2006.01)
*B24D 3/28* (2006.01)
*B24D 18/00* (2006.01)

(52) U.S. Cl.
CPC ..... *B24D 18/0009* (2013.01); *B24D 2203/00* (2013.01)

(56) References Cited

U.S. PATENT DOCUMENTS

| | | | | |
|---|---|---|---|---|
| 5,369,916 | A | 12/1994 | Jefferies et al. | |
| 5,910,471 | A | 6/1999 | Christianson et al. | |
| 5,984,764 | A | 11/1999 | Saito et al. | |
| 6,361,414 | B1 | 3/2002 | Ravkin et al. | |
| 6,400,998 | B1 * | 6/2002 | Yamazaki | G05B 19/401 700/86 |
| 6,471,733 | B1 | 10/2002 | Cooper | |
| 6,572,463 | B1 | 6/2003 | Xu et al. | |
| 6,645,046 | B1 | 11/2003 | Vogtmann et al. | |
| 8,694,149 | B2 * | 4/2014 | Diehl | G05B 19/40937 700/190 |
| 2005/0202754 | A1 | 9/2005 | Bechtold et al. | |
| 2007/0021036 | A1 | 1/2007 | Kuebler et al. | |
| 2012/0196510 | A1 * | 8/2012 | Franklin | B24B 19/26 451/5 |
| 2012/0289125 | A1 | 11/2012 | Billig et al. | |
| 2012/0295516 | A1 * | 11/2012 | Guo | B23Q 1/626 451/5 |
| 2012/0330447 | A1 * | 12/2012 | Gerlach | G01B 11/24 382/128 |
| 2014/0113525 | A1 * | 4/2014 | Chan | G05B 19/19 451/5 |
| 2016/0243664 | A1 * | 8/2016 | Nagata | B23Q 17/249 |
| 2017/0129066 | A1 * | 5/2017 | Okuda | B24B 49/12 |
| 2018/0141184 | A1 * | 5/2018 | Mao | B25J 9/1666 |

FOREIGN PATENT DOCUMENTS

| | | | | |
|---|---|---|---|---|
| DE | 4205299 | A1 | 8/1993 | |
| DE | 202015001082 | U1 | 2/2015 | |
| DE | 102014017307 | A1 * | 5/2016 | B25J 19/022 |
| DE | 102015119240 | B3 * | 3/2017 | B24B 51/00 |
| EP | 0353638 | A2 | 2/1990 | |
| EP | 0650803 | A1 | 5/1995 | |
| EP | 0913229 | A1 | 5/1999 | |
| EP | 1369201 | A1 | 12/2003 | |
| EP | 1886764 | A1 | 2/2008 | |
| EP | 2615413 | A1 * | 7/2013 | B21D 1/12 |
| JP | 2006263869 | A | 10/2006 | |
| WO | 0174535 | A1 | 10/2001 | |
| WO | 2005068133 | A1 | 7/2005 | |
| WO | 2016051121 | A1 | 4/2016 | |

OTHER PUBLICATIONS

Intellectual Property Office, "Patents Act 1977: Examination Report under Section 18(3) from GB Application No. 1621699.6", Nov. 17, 2021, pp. 1 through 4, Published: GB.

State Intellectual Property Office, P.R. China, "Office Action from CN Application No. 201780083455.6", from Foreign Counterpart to U.S. Application No. 16/469,108, Sep. 3, 2021, pp. 1-11, Published: CN.

Wikipedia, "Grinding (abrasive cutting)", Wikipedia, dated Jun. 14, 2015, accessed Nov. 16, 2021, https://web.archive.org/web/20150614094750/https://en.wikipedia.org/wiki/Grinding_(abrasive_cutting).

International Searching Authority, "International Search Report from PCT Application No. PCT/ GB2017/053773 dated Jul. 11, 18", pp. 1-9, Published: WO.

UK Intellectual Property Office, "Search Report from GB Application No. 1621699.6 dated Apr. 16, 18", pp. 1-4, Published: GB.

* cited by examiner

METHODS AND APPARATUS FOR SHAPING WORKPIECES

CROSS-REFERENCE TO RELATED APPLICATIONS

This application claims priority to International Patent Application No. PCT/GB2017/053773 filed on Dec. 15, 2017, which claims priority to GB Patent Application No. 1621699.6 filed on Dec. 16, 2016, both of which are incorporated herein by reference.

The present invention relates to methods and apparatus for shaping workpieces, and is particularly concerned with shaping workpieces using tools which have a flexible working surface and are pressed against a workpiece to form a tool footprint by deforming the surface of the tool against the workpiece, and are rotated about an axis inclined to the workpiece surface so that the working surface of the tool within the tool footprint is moving relative to the workpiece surface. The tool footprint is moved over the workpiece surface by relative movement of the tool and the workpiece, so that the tool footprint reaches all parts of the surface to be worked. At the tool footprint, an abrasive working surface of the tool removes material from the workpiece to produce the required workpiece shape and finish.

In one aspect of the invention the shaping tool comprises a flexible tool surface on which are arrayed a number of substantially rigid pellets, into which abrasive particles are embedded. For tools of this type, an aspect of the invention provides a method of determining tool control parameters which, when applied in a shaping process, ensure that the shaping process is able to remove material from the workpiece at the largest possible rates, while doing so under ductile cutting conditions which result in reduced sub-surface damage and improved surface finish quality.

A further aspect of the invention provides a system in which data representing the surface form of the workpiece is analysed in order either to select a tool able to perform the required shaping and/or finishing operation from a range of standard spherical tools, or to determine the required geometry of a non-standard tool to perform the required shaping and/or finishing operation. The workpiece surface data may further be analysed in order to produce tool control data including a tool path for moving the tool footprint over the workpiece.

A further aspect of the invention provides manufacturing of tools for use in the shaping process, including methods and apparatus for pre-conditioning the abrasive working surface of the tool.

A further aspect of the present invention relates to a system for monitoring tool wear as a result of the tool being used in shaping operations, in order to identify when a tool is nearing, or has reached, the end of its usable life.

Aspects and embodiments of the invention will now be described in detail with reference to the accompanying drawings, in which:

FIG. 1 is an overview of a method and system for shaping a workpiece in accordance with various aspects of the present invention;

FIGS. 1*a* and 1*b* show the overall process steps to arrive at a finished product using the shaping process of the invention;

Figure 3:
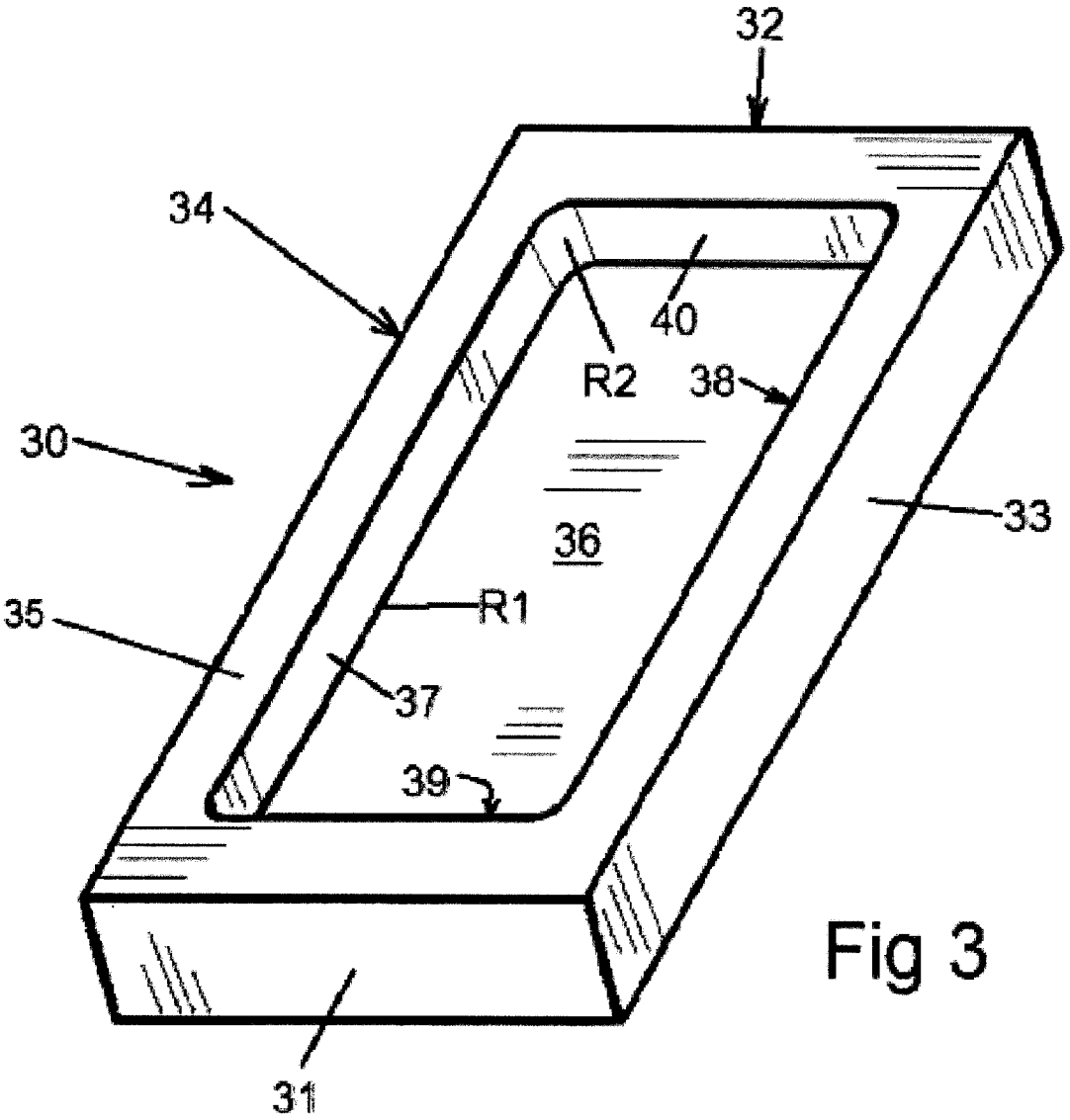
FIG. 3 is a perspective view of a sample component.
Figure 3A:
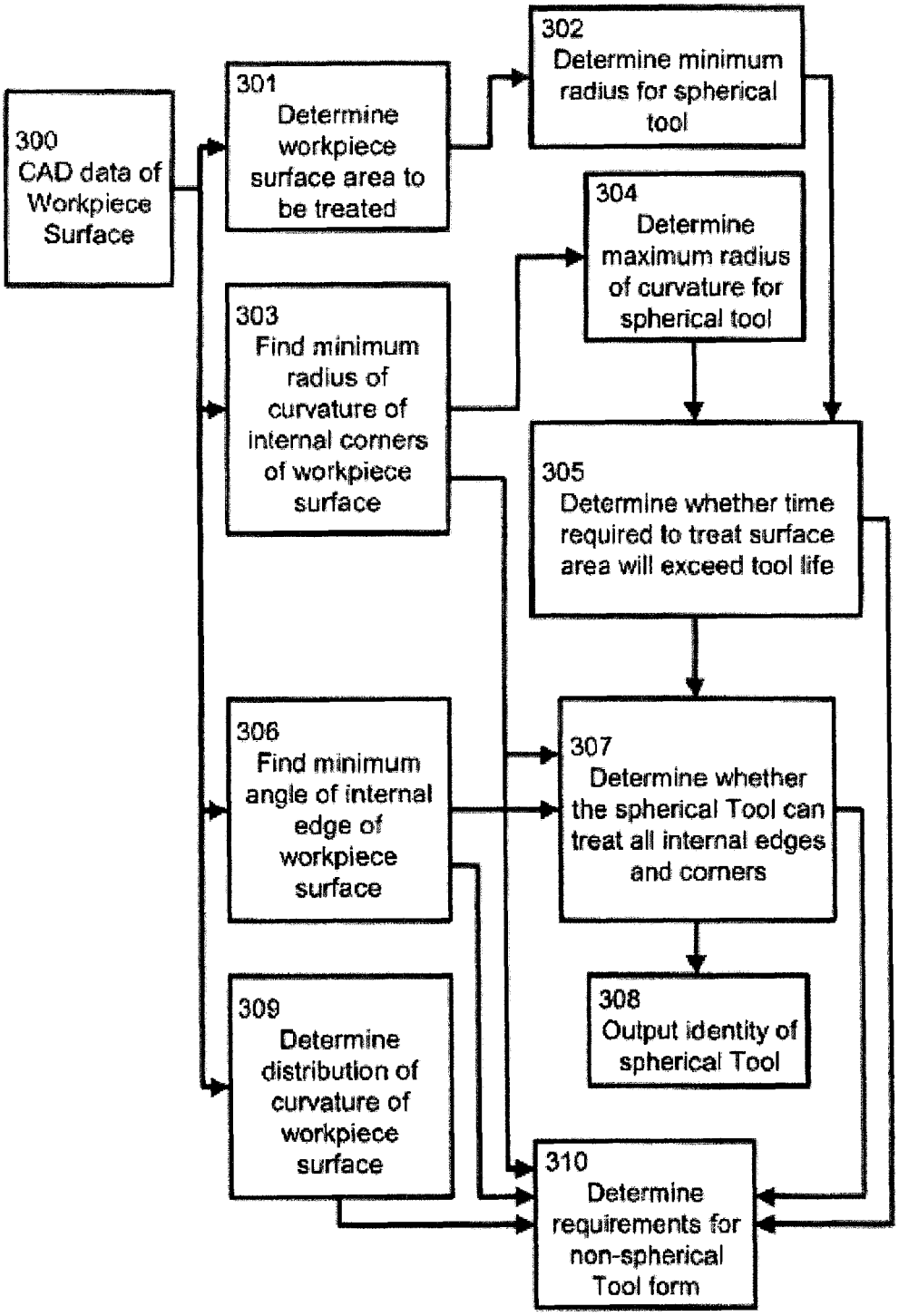
Figure 4C:
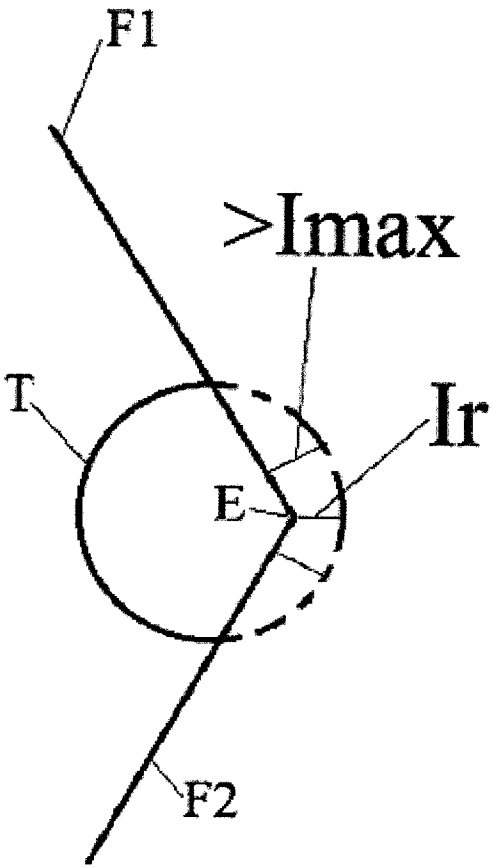
Figure 4B:
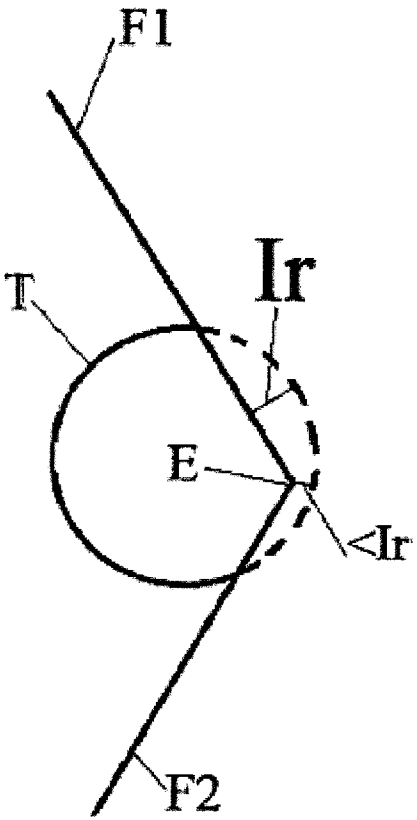
Figure 4A:
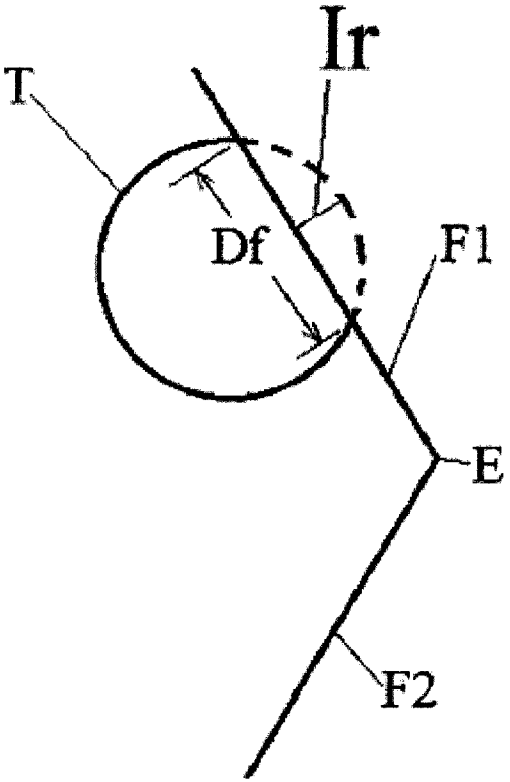
Figure 4D:
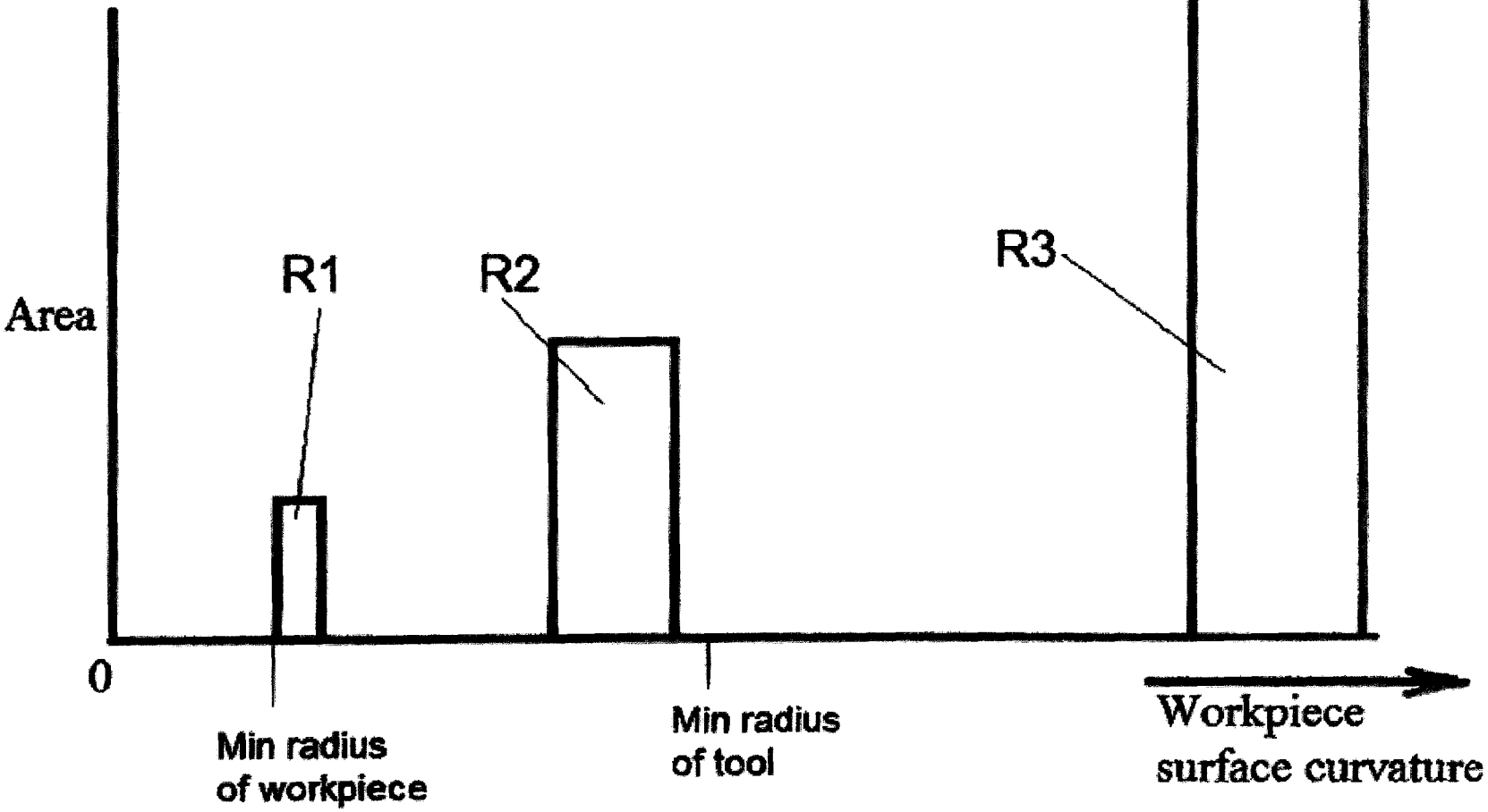

FIG. 3*a* illustrates the analysis of the workpiece surface to determine the required tool form for the shaping operation;

FIGS. 4*a* to 4*c* is a schematic diagram illustrating the changes in offset as a spherical tool approaches an internal edge;

FIG. 4*d* is a histogram representing the surface of the sample component of FIG. 3.

Figure 5B:
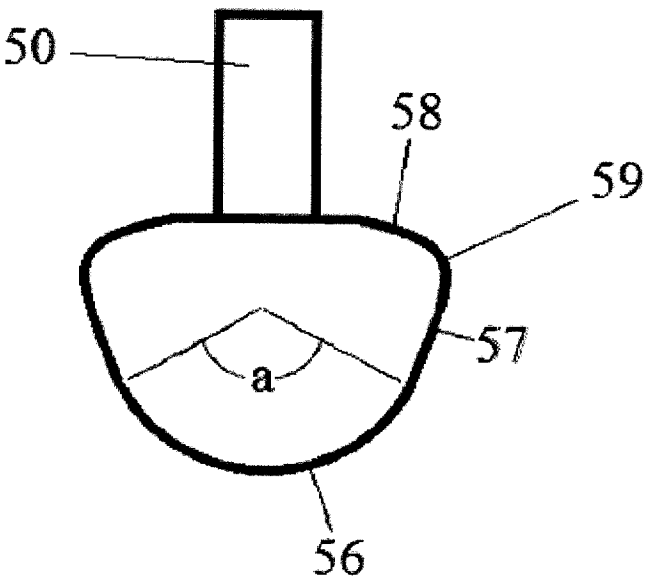
Figure 5A:
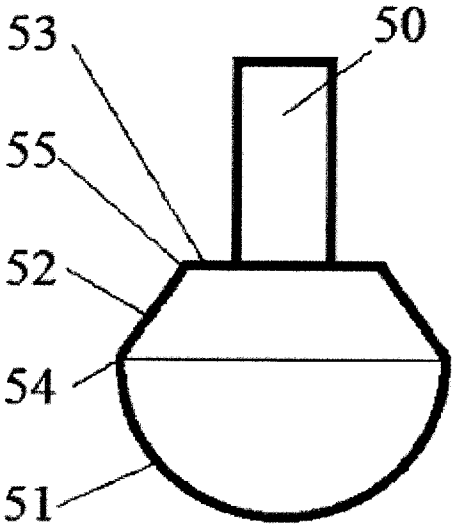
Figure 6A:
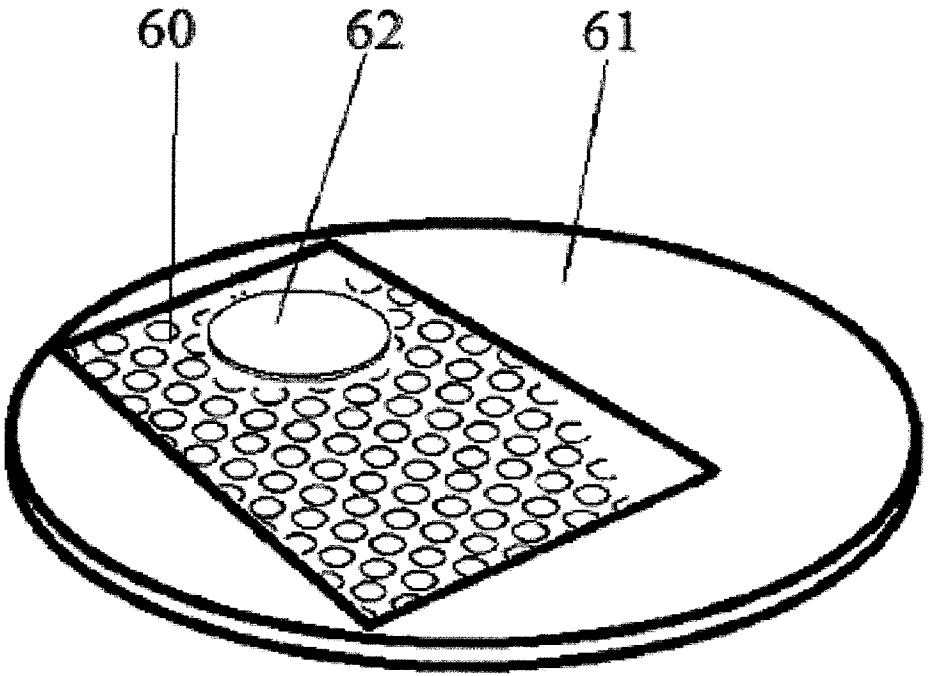
Figure 6B:
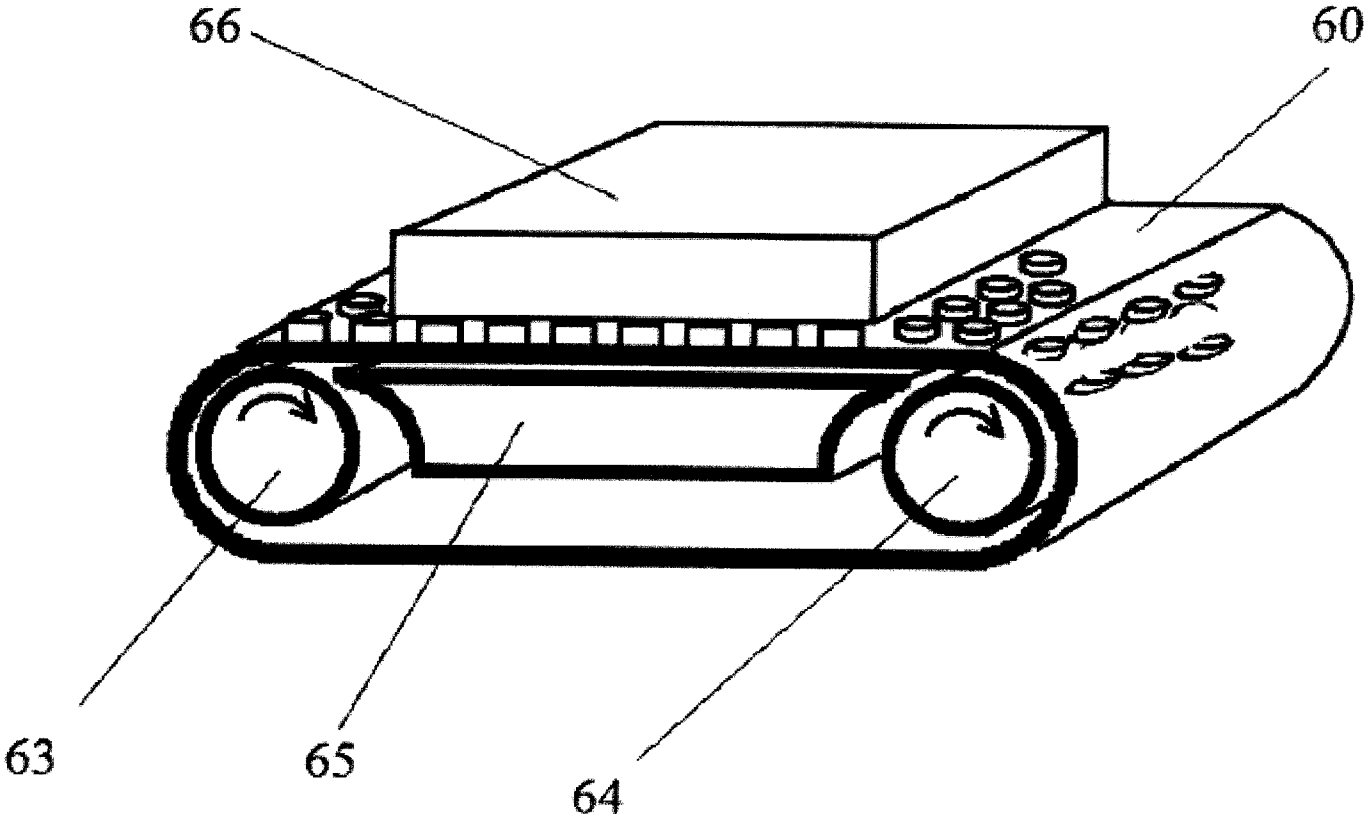
Figure 7A:
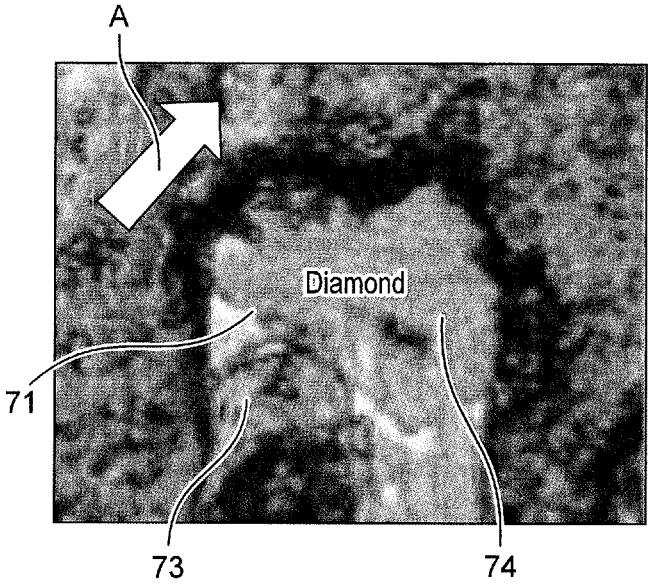
Figure 7B:
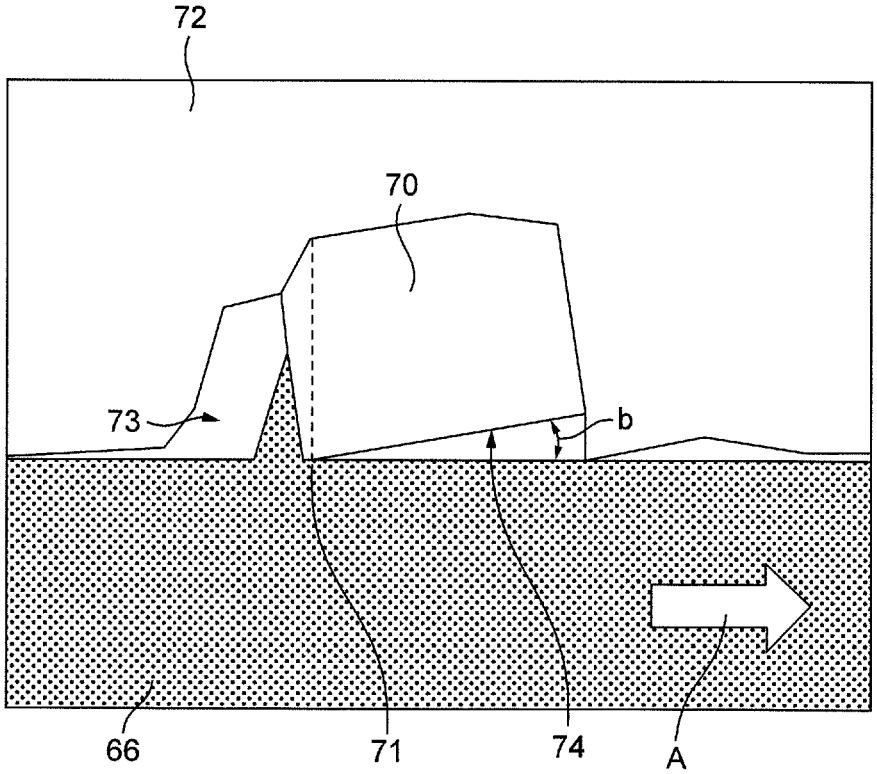

FIGS. 5*a* and 5*b* show examples of non-spherical tools;

FIGS. 5*c* to 5*g* illustrate stages in the manufacture of a shaping tool;

FIGS. 6*a* and 6*b* illustrate alternative apparatus and methods for conditioning the pelleted sheet material;

FIG. 7*a* is a micrograph of an exposed abrasive particle in a pellet;

FIG. 7*b* is a schematic sectional view of the abrasive particle of FIG. 7*a;*

Figure 8:
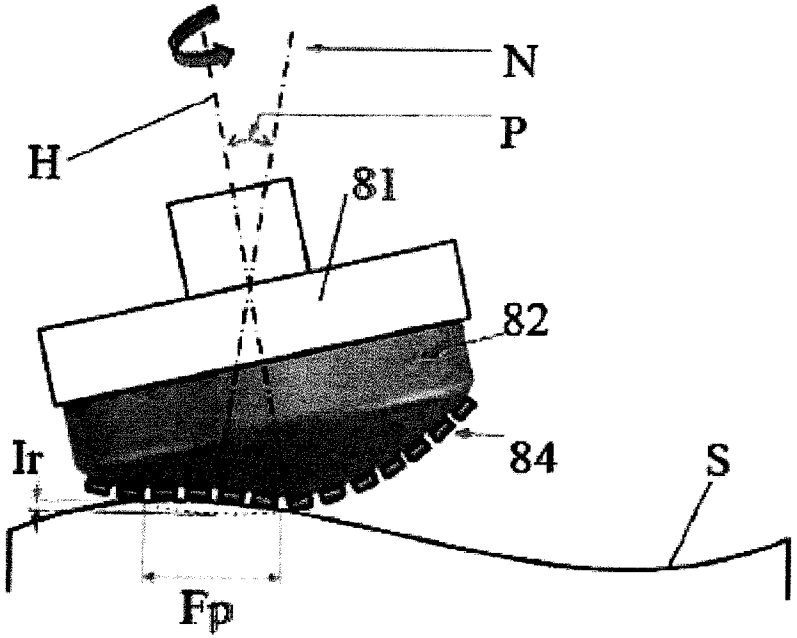
Figures 9, 9A, 9B, 9C, 9D, 9E, 9F:
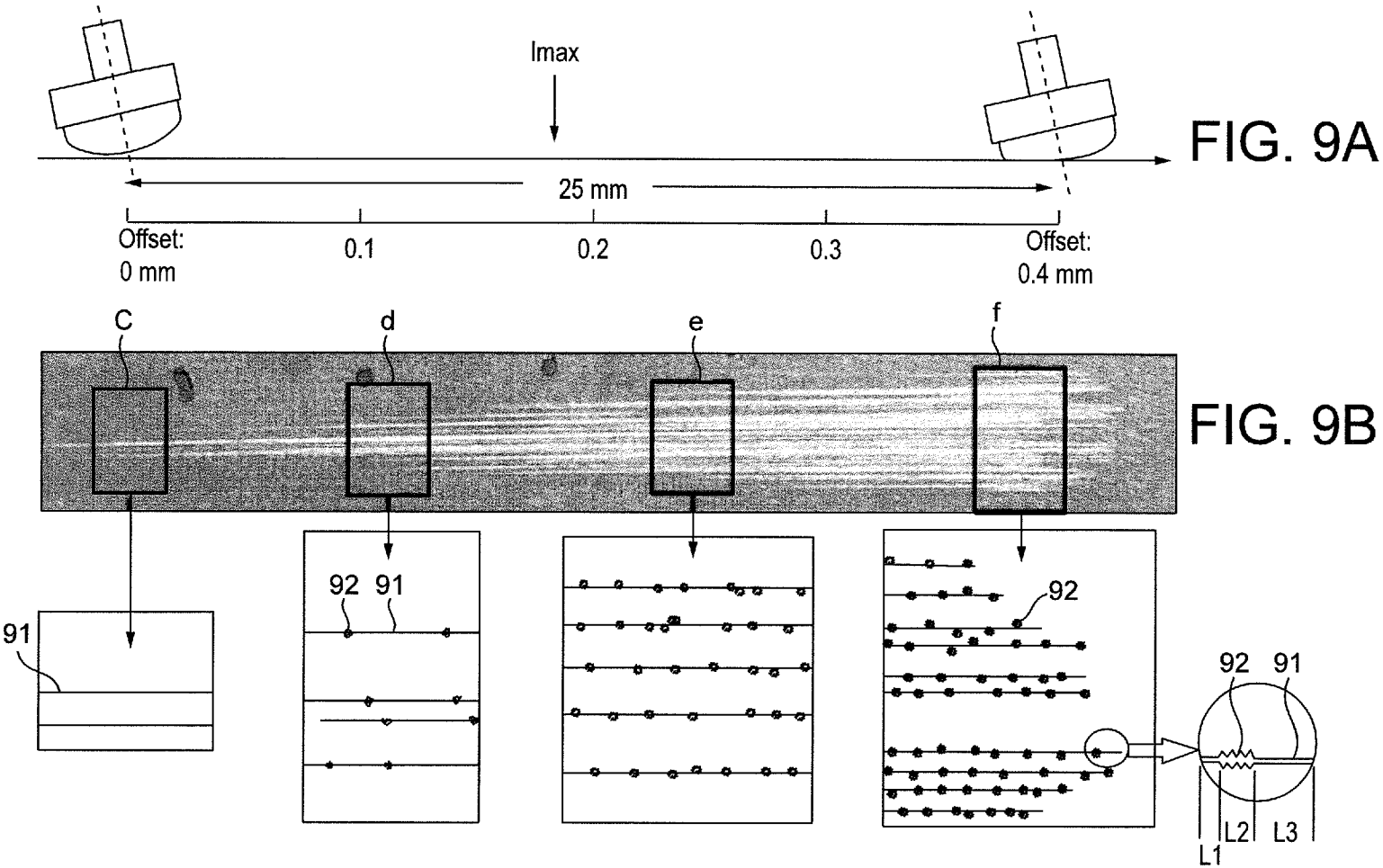
Figure 10:
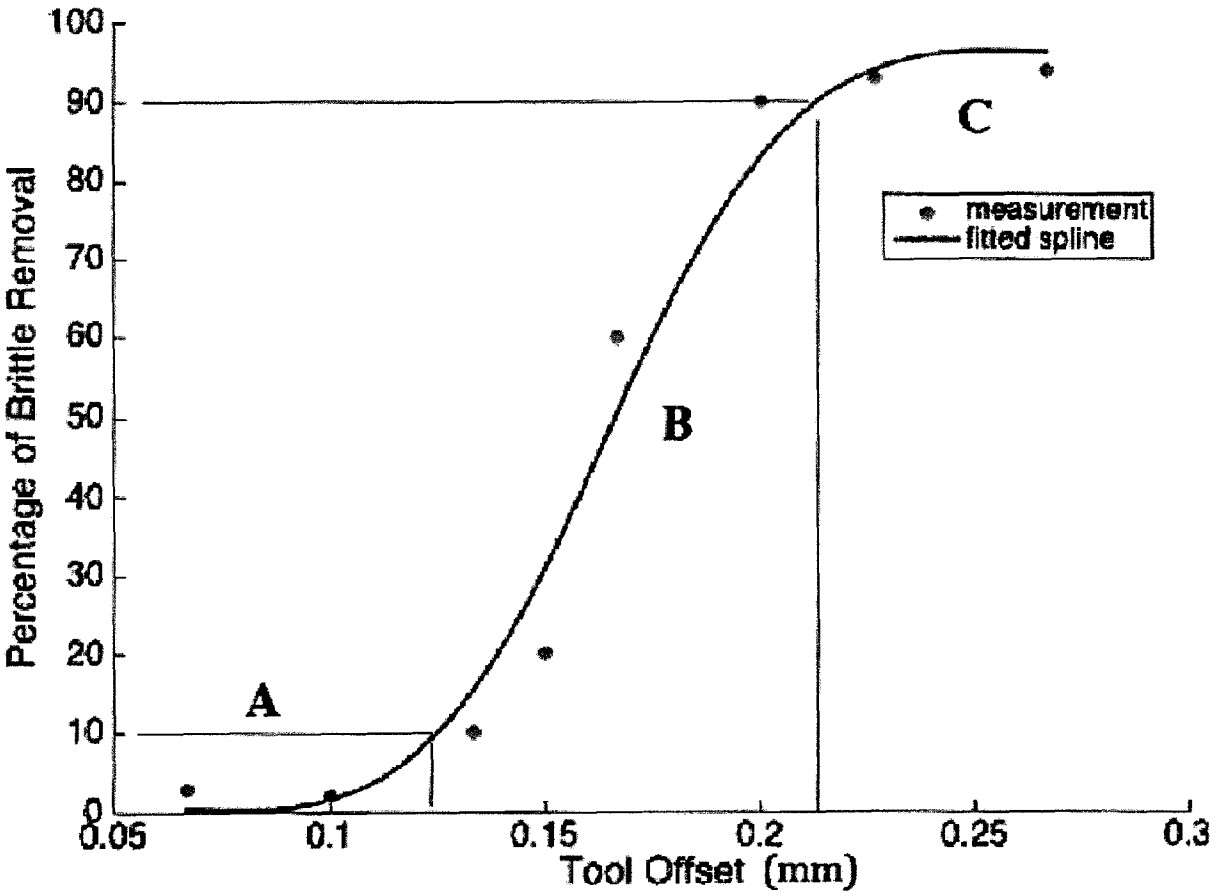
Figure 11B:
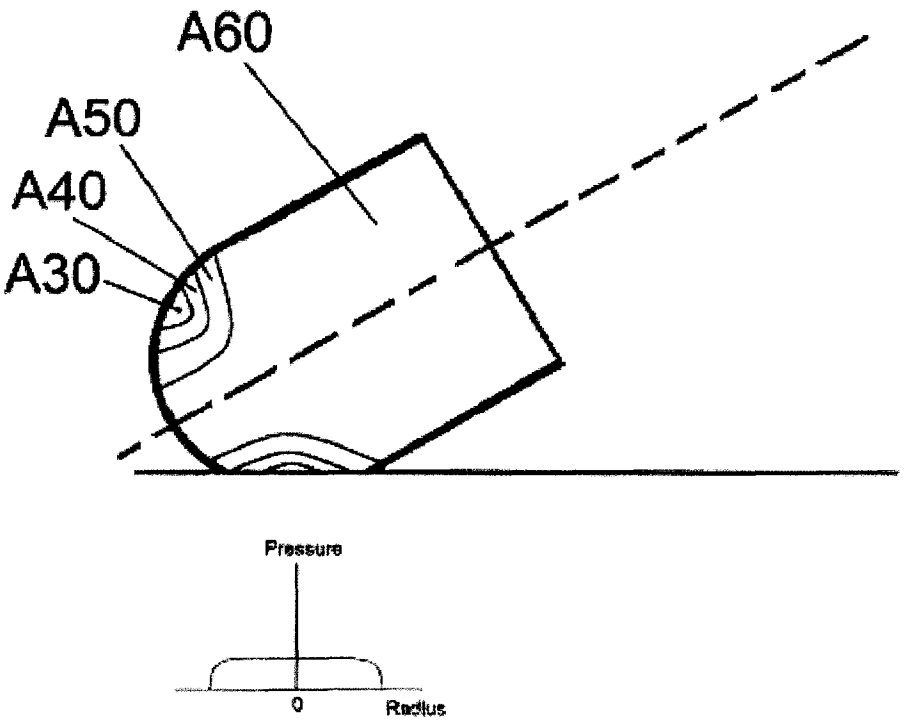
Figure 11A:
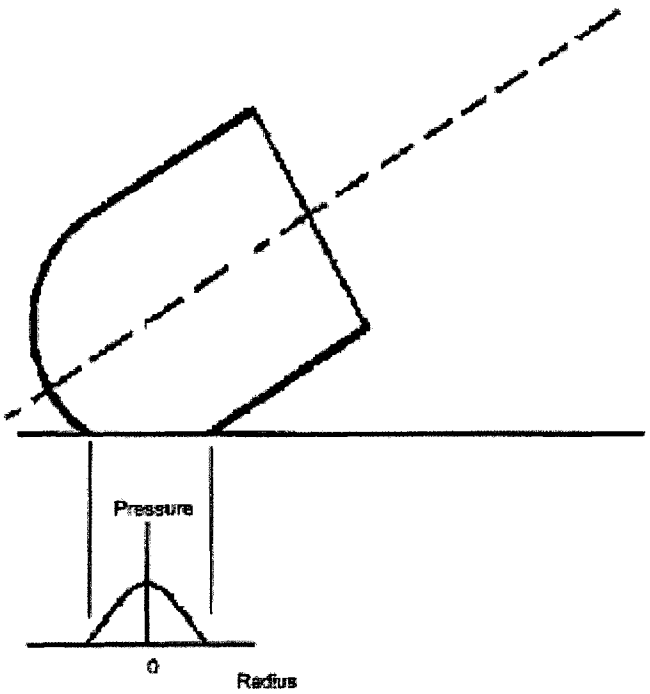
Figure 11C:
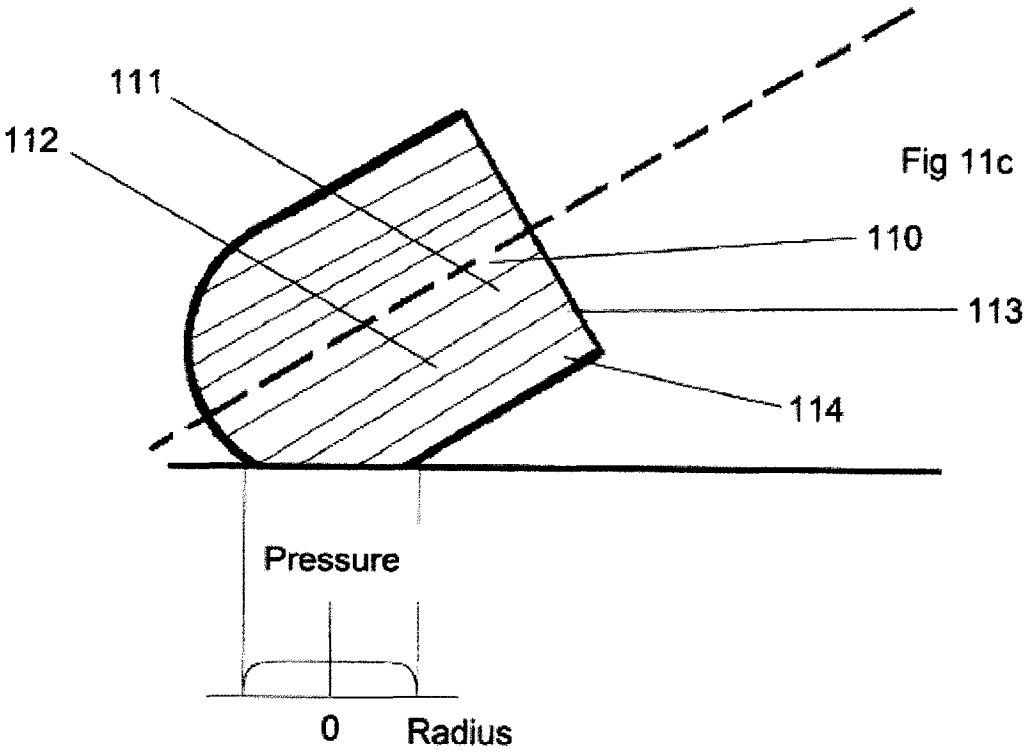
Figure 12A:
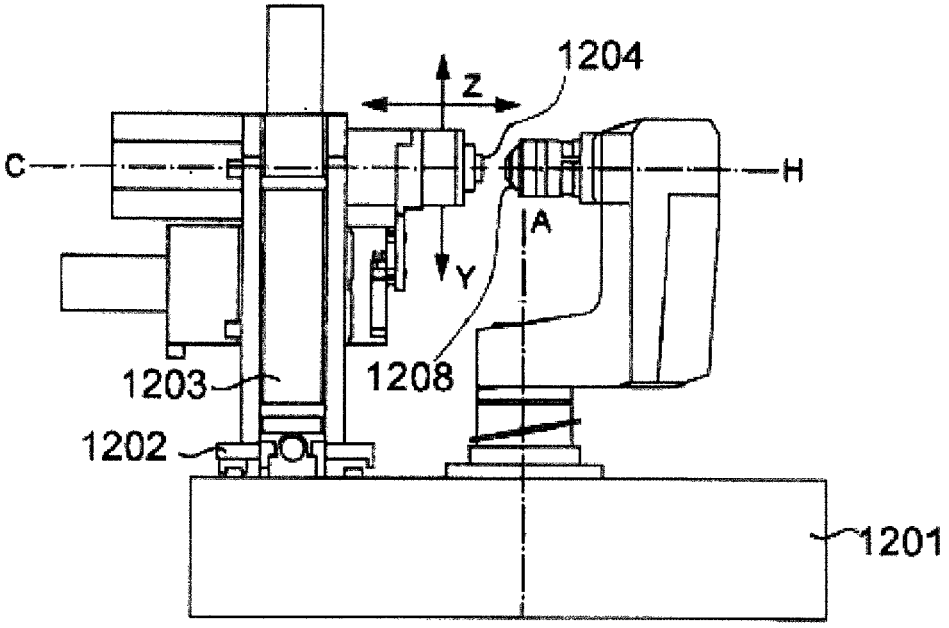
Figure 12B:
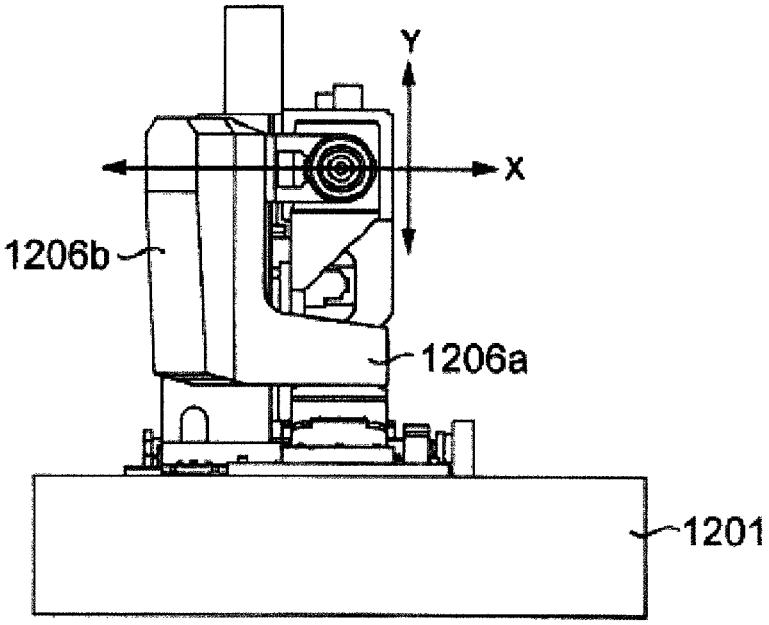
Figure 12C:
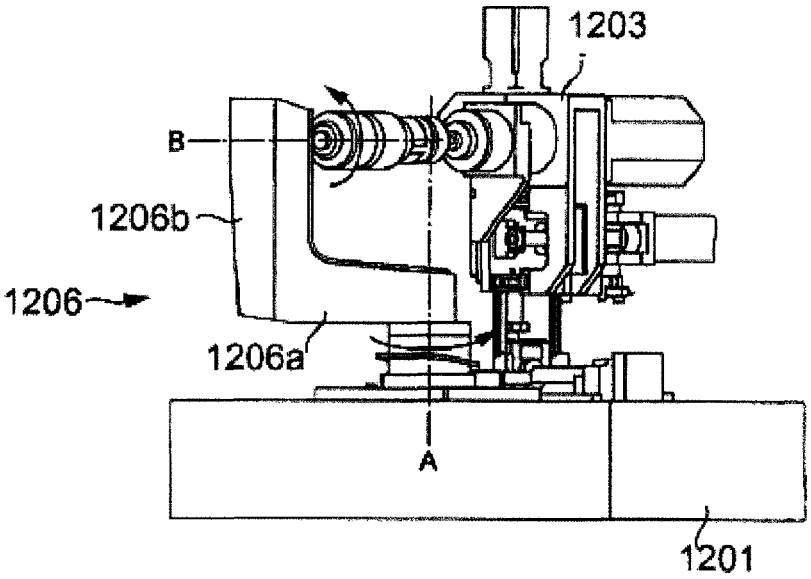
Figure 12D:
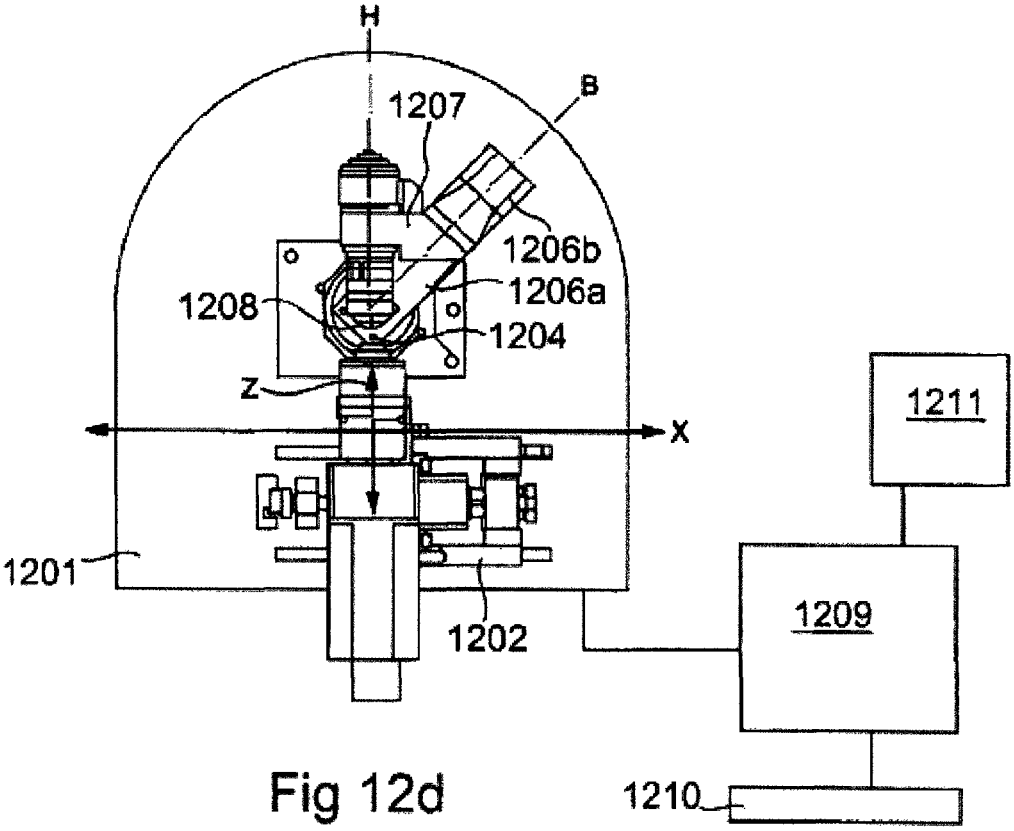

FIG. 8 is a schematic side view of a part-spherical flexible pelleted grinding tool in operation;

FIG. 9 illustrates a testing process to determine the maximum tool offset for ductile shaping of a workpiece;

FIG. 10 illustrates the relationship between tool offset and the percentage of brittle fracturing of a workpiece;

FIG. 11*a* illustrates the pressure distribution over the tool footprint for a homogeneous resilient tool;

FIGS. 11*b* and 11*c* illustrate alternative non-homogeneous resilient tools and their respective pressure distributions; and FIGS. 12*a* to 12*d* are left side, front, right side and top views, respectively, of a shaping machine using a shaping tool to shape a workpiece.

Figure 1:
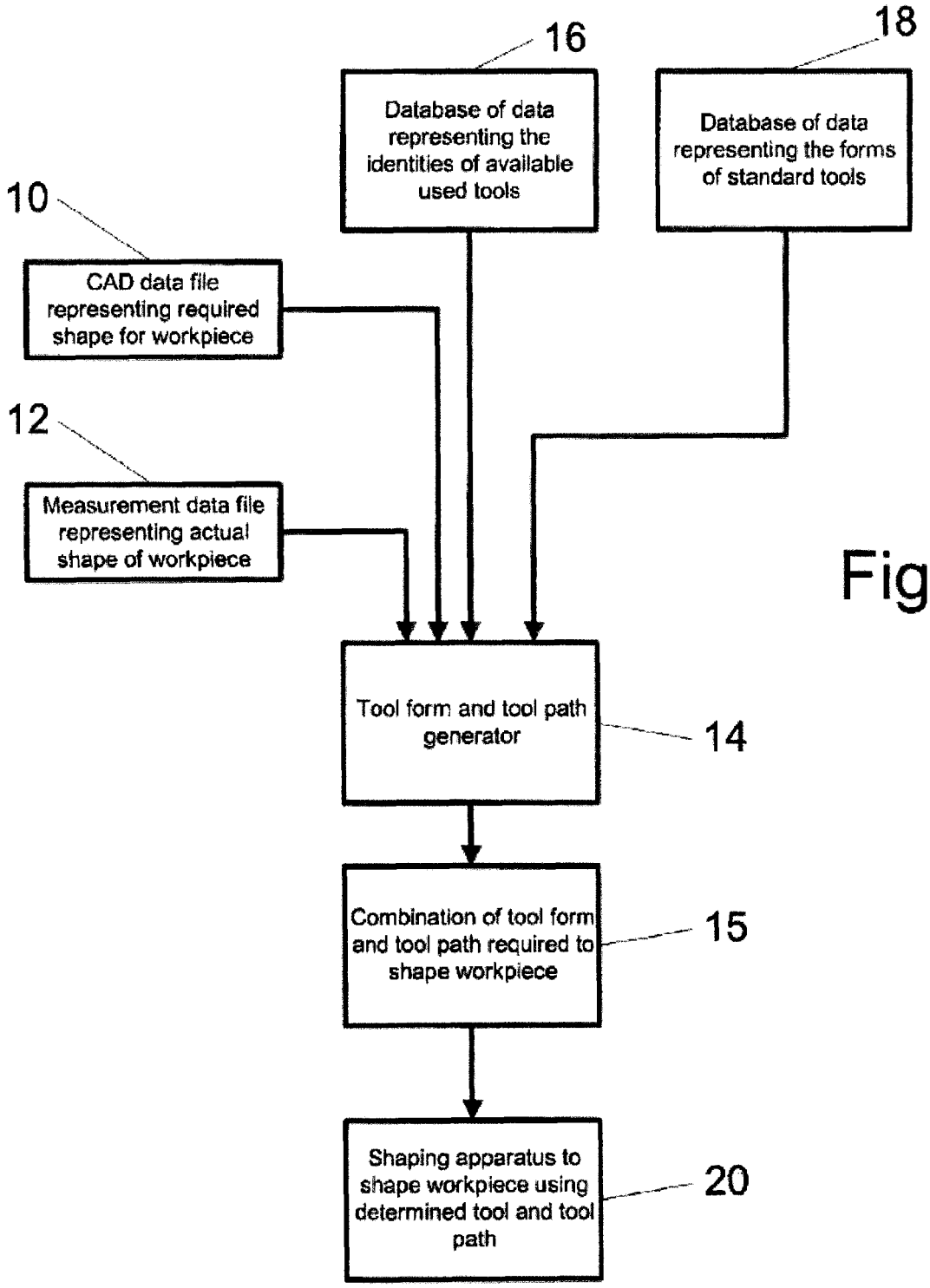
Figure 2:
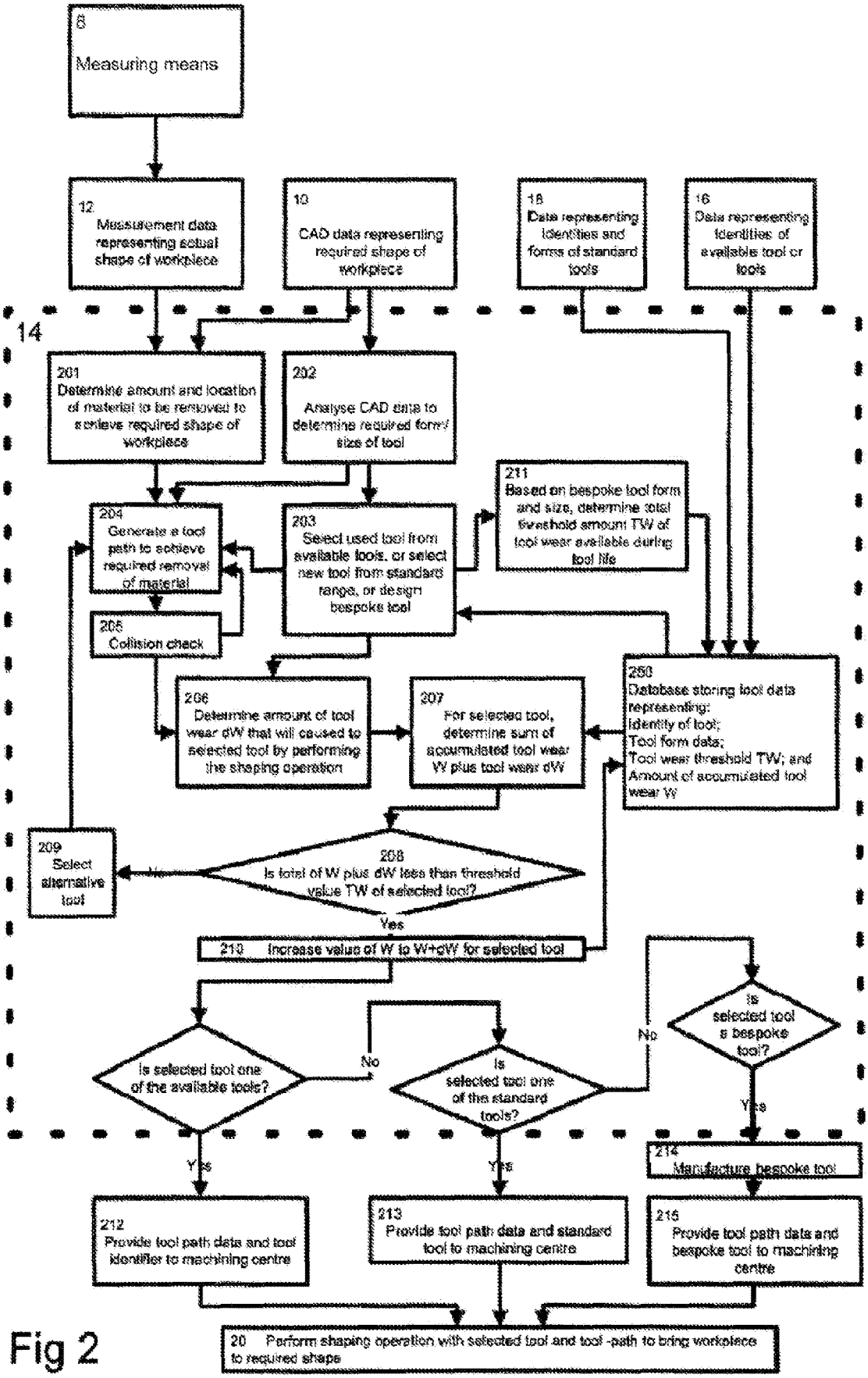
FIG. 2 is a more detailed explanation of the tool form and tool path generation steps of FIG. 1.

An overview of the workpiece shaping system, showing the stages in a workpiece shaping operation, is set out in FIGS. 1 and 2.

Figure 1A:
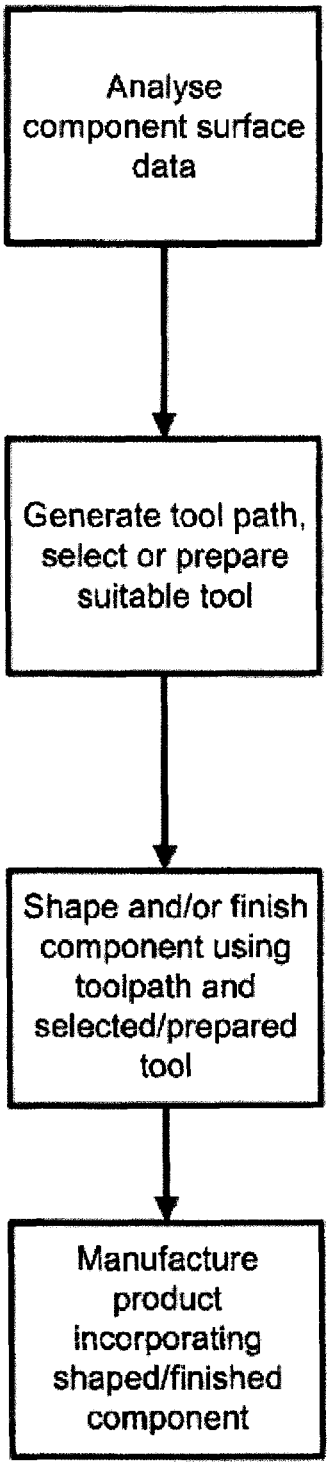
Figure 1B:
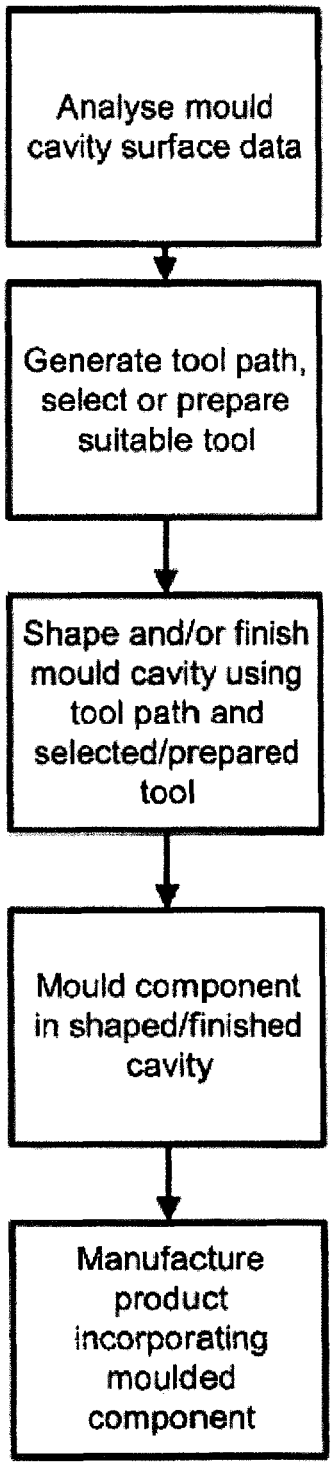

Typically the shaping operation carried out using the system of the present invention will be a shaping and finishing operation to bring a roughly-formed workpiece to its final, required, shape and finish. The workpiece which is shaped by the shaping operation may then be incorporated in a final product, as outlined in the flowchart of FIG. 1*a*. Alternatively, the workpiece shaped by the shaping operation may be a part of a mould cavity from which a component is moulded, and that component may then be incorporated in a final product, as outlined in the flowchart of FIG. 1*b*.

Referring now to FIGS. 1 and 2, in a first stage of the process, a set of CAD data 10 representing the required shape of the workpiece, and a set of measurement data 12 from measurements representing the actual shape of the workpiece, are received at a tool form and toolpath generator 14.

The tool form and tool path generator 14 also receives available tool data from a database 16, representing the identities of tools which have already been used for some shaping processes, but are not at the end of their working life. A database of standard tool data 18 representing the forms of standard tools is also available to the tool form and toolpath generator 14. On the basis of this accumulated data, the tool form and tool path generator 14 performs various functions.

One function of the tool path generator 14 is to determine, by comparing the CAD data 10 and the measurement data 12 at step 201 (FIG. 2) how much material is to be removed from the workpiece, and where the material is to be removed from, in order to bring the workpiece to the required shape and finish. In determining the amount of material to be removed from the workpiece, account is taken of immediate sub-surface damage which the workpiece has already suffered, and the amount of material to be removed is adjusted so that any damaged surface regions of the workpiece are removed, leaving a smooth and polished surface free from sub-surface cracking or other damage. The depth of material to be removed at each point is calculated from the difference between the measurement data 12 and the CAD data 10 of that point. The tool path generator 14 determines the amount of material to be removed from the workpiece at the point where the measurement data 12 and the CAD data 10 are closest together, and generates a tool path which will result in the removal of at least this minimum amount of material from all points on the surface of the workpiece, in order to ensure that any sub-surface damage is polished out.

The tool form and tool path generator 14 then analyses the required shape of the workpiece at step 202 to determine a form (shape) of tool which is able to treat all of the areas of the workpiece. This determination may involve a selection (step 203) from the used tools which are available (represented by available tool data 16 stored in database 250), or it may be a selection from a standard range of tools (based on the standard tool data 18 stored in database 250), or in some cases a non-standard tool form may be required and a bespoke tool will have to be produced.

After selecting or generating the shape and size (form) of the tool required to treat all of the workpiece surface, the tool form and tool path generator 14 then generates at step 204 a tool path which describes the movement required of the tool over the workpiece in order to remove the material from the workpiece to bring it to the required shape and finish.

The combination 15 of tool path data and either the identity of an available tool, or a new standard or bespoke tool is then provided to a shaping apparatus 20.

In the final step the workpiece is shaped by the shaping apparatus 20 moving the tool over the workpiece along the determined tool path to arrive at the required shape for the workpiece. The finished workpiece may form part of a final product, or may be a mould cavity in which a component is moulded for later incorporation into a final product.

Generating the Tool Path

The tool path data will include the three-dimensional components of the movement of the tool relative to the workpiece. The tool path will thus define the tool "offset", i.e. the amount of deformation of the tool against the workpiece surface which defines the size of the tool footprint, at each point along the tool path. The tool path data may also define the speed of translation of the tool across the workpiece surface, which may be constant or which may vary at different parts of the tool path, and optionally also include data concerning a rotational speed of the tool and a precession angle of the tool rotation axis relative to the tool footprint on the workpiece surface.

An important check to perform during the generation of the tool path is the collision check, step 205. This step simulates the shaping operation to ensure that at no time during the shaping operation does the tool stem or any other part of the tool mounting or the shaping machine collide with the workpiece. In the event of such a collision, the tool path generating software may vary the tool path by changing the tool attitude, or the design of the tool may be altered for example to reduce or reshape the tool stem, and calculates a new tool path at step 204. The generation of the tool path is an iterative process which eventually arrives at a combination of a tool profile and a tool path which can treat all of the parts of the surface, which avoids collision with the workpiece, and which provides a treatment time which is not excessive. Optionally, one of the inputs to the tool path generator may be a time limitation, specifying the maximum amount of time allowed for bringing the workpiece from its measured shape to the required shape.

The tool path generator then determines at step 206 the amount of wear dW that the tool will experience when performing this shaping operation, and verifies in steps 207 and 208 that the selected tool is capable of sustaining this amount dW of wear without exceeding a wear threshold TW indicative of the working life of the tool. The calculation of dW is based on the amount of material to be removed from the workpiece and the surface configuration of the tool. This check ensures that the tool will be able to complete the required shaping operation i.e. that the working surface of the tool will not become so worn during the shaping operation that the tool is unable to complete the operation.

If the sum of the amount of wear dW produced by the shaping operation and the existing wear of the tool will exceed the threshold TW value of the tool selected, then the tool path generator 14 selects an alternative tool form at step 209 and returns to step 204 to generate an alternative tool path to perform the required shaping operation.

When the tool path generator 14 arrives at a combination 15 of a tool selection and a tool path which can perform the required shaping operation without exceeding the wear threshold TW of the selected tool, the tool path generator 14 updates the database 250 at step 210. Then if the selected tool is one of the used tools available, then at step 212 the tool path data is provided to a shaping machine such as a CNC machining centre, together with the identity of the selected used tool. The machining centre then operates at step 20 to move the selected used tool over the workpiece following the tool path data in order to shape the workpiece.

If the selected tool is one of the standard range of tools available, then the tool path data is provided to the shaping machine at step 213, together with the identity of the selected standard tool. A standard tool may be provided to the machining centre, together with the tool path data, or the standard tool may be obtained from other sources. The machining centre then operates to move the selected standard tool over the workpiece following the tool path data in order to shape the workpiece.

If the tool path generator 14 is unable to generate a tool path which can be successfully followed by either an available used tool or a standard tool form, then the tool path generator will generate at step 203 a bespoke tool form and at step 204 a corresponding tool path for moving the bespoke tool over the workpiece to bring the workpiece to the required shape. The tool path generator 14 also calculates, at step 211, the threshold amount TW of tool wear that the bespoke tool can tolerate during its life, and feeds this to the database with the identity and form data for the bespoke tool. The bespoke tool is then manufactured at step 214 and provided to a shaping machine, together with the corresponding tool path data, and the shaping machine then operates to move the tool over the workpiece to shape the workpiece. The database is then updated to reflect the amount of wear suffered by the bespoke tool during the shaping operation.

The tool path generator 14 maintains a database 250 which stores identity data for each individual tool, and for each tool also stores data concerning the tool form and a threshold amount of tool wear TW which can be sustained by the tool during its working life, i.e. before the tool becomes unusable. This threshold amount of wear TW is calculated based on the surface area and the shape of the tool. The database also stores, for each tool, an accumulated amount W of tool wear corresponding to the shaping operations which the tool has performed since its production.

Tool Form Selection

In order to select the most appropriate tool to complete each shaping operation in the most efficient manner, the surface of the workpiece is analysed to determine the shape of tool required in order to shape and/or finish all parts of the workpiece surface. In the case of a spherical treatment tool, a large radius tool can achieve a large treatment footprint and thus the surface of the workpiece can be shaped and/or finished in a short treatment time. However, if the workpiece surface includes sharply curved concave areas, or edges where faces of the workpiece surface intersect at acute angles, then a large-radius spherical tool may not be able to treat these surface areas. If the radius of the tool is reduced, the tool is able to enter these sharply-curved regions of the workpiece surface, but since the tool footprint is correspondingly reduced then the time for treating the surface will be increased. Furthermore, since the overall surface area of the tool will be reduced, each part of the tool surface will wear away at a greater rate than would be the case with a larger-radius tool.

FIG. 3 is a perspective view of a sample component for shaping using the method of the present invention. The sample component is intended to form part of a mould cavity. The sample component illustrated comprises a generally rectangular block 30 having a pair of end surfaces 31 and 32 and a pair of side surfaces 33 and 34. In a top surface 35 of the block, there is a generally rectangular recess which has a flat base 36, a pair of vertical sides 37 and 38, and a pair of vertical ends 39 and 40. The sides and ends 37 to 40 are blended to the base 36 by a radiussed region R1, and to each other by larger-radius regions R2.

The area of the sample component to be shaped/finished comprises the internal surfaces of the recess 36. The area of the sample component to be treated is thus formed mainly by flat surfaces, namely the base 36 and the sides and ends 37 to 40 of the recess. A smaller proportion of the surface to be treated comprises the small-radius highly curved region R1 blending the sides 37 to 40 of the recess to the base 36, and the larger-radius curved regions R2 blending the end walls 39 and 40 to the sidewalls 37 and 38.

While it is advantageous to use one of a range of "standard" spherical or part-spherical tools, it is sometimes not possible to achieve an acceptable result with a spherical tool. For example if the workpiece has a surface which is predominantly flat but has sharp-radiussed internal corners, as is the case with the sample component of FIG. 3, then a spherical tool with a radius equal to or smaller than the smallest-radiussed internal corners of the workpiece will have to be selected in order to treat the entire surface of the workpiece. However, such a small-radiussed tool will take a long time to treat the larger, flat areas of the workpiece surface due to its small treatment footprint. Indeed, the small surface area of such a tool may have the result that the working life of the tool may be less than the time required to treat the entire area of the workpiece surface. For such cases, non-spherical tools are provided which include a part of the tool surface optimised for treating the flatter areas of the workpiece, and one or more acutely-angled or sharply curved regions of the tool surface which are able to treat the internal corners of the workpiece. The part of the tool surface optimised for treating the flatter areas of the workpiece may be hemispherical or part-spherical, in order to provide a generally circular tool footprint on the workpiece.

In order to treat all of the internal surfaces of the recess of the sample component illustrated in FIG. 3, a spherical or part-spherical tool having a radius equal to the internal radius R1 of the blending region could be chosen, since such a tool would be able to engage all parts of the surfaces of the recess. However, the total surface area of such a tool would be extremely small, leading to a short working life for the tool. Furthermore, the size of tool footprint which such an extremely small tool could generate on the sample component is also small, so that only a very small area of the sample component can be treated at any time. This would result in an extremely long processing time for the small footprint to move over the comparatively large areas of the base 36 and side walls 37 to 40.

Workpiece Surface Analysis

The determination of the optimum shape and size of tool for the particular workpiece is made by an analysis of the workpiece surface data undertaken by a processor, using digital data representing the form (shape and dimensions) of the workpiece surface to be treated. This digital data 300 may be a CAD file defining the surface to be achieved. An explanation of the analysis now follows, with reference to FIG. 3*a*.

The first step in the analysis is to determine at step 301 the total area of the surface which requires treatment, as this defines a minimum radius for a spherical tool so as to provide sufficient surface area of abrasive material to be able to treat the surface area of the workpiece without wearing out the tool. In relation to the sample component illustrated in FIG. 3, the area to be treated comprises the combined areas of the base 36, the sidewalls 37 and 38, the end wall 39 and 40, the blending region R1 and the four curved corner regions R2. The total area A to be treated may be approximated from the length l, width w and depth d of the recess using the formula:

$$A=lw+2ld+2wd$$

At step 302, the minimum radius for a spherical tool with sufficient surface area to treat this area of the workpiece surface is determined.

(1) For a given tool radius (TR [mm]) and tool offset (TO [mm]), the tool produces a tool footprint of diameter S1(TR, TO) [mm];

(2) By adding the tool hardness and workpiece hardness (TH, WH), a function RR to describe the material removal rate at each point along the tool path: RR(TR,TO,TH,WH) [$mm^3$/min] is formulated;

(3) To avoid cusping, the track spacing TS (the distance between adjacent stretches of the tool path) should be such that the tool footprint is overlapped by at least 20 tracks: TS [mm]=S1/20.

(4) To maximize productivity, the machine should be running close to its maximum feed rate FMax [mm/min], which may be about 3000 mm/min:

(5) Comparing the measured workpiece to the ideal workpiece, a target material removal depth (WD [mm]) for each point on the workpiece area (WA [$mm^2$]) is found. By summing these depths and areas, the total volume WV [$mm^3$]=WD*WA of workpiece material to be removed is calculated.

(6) The total path length (PL [mm]) is a function of the workpiece area and track spacing: PL=WA/TS The total volume of material to be removed can then be expressed as a function of the removal rate RR at each point along the tool path times the total length PL of the tool path:

$$\begin{aligned} WV &= RR(TR, TO, TH, WH) * PL / FMax \\ &= RR(TR, TO, TH, WH) * WA / (Fmax * TS) \\ &= RR(TR, TO, TH, WH) * WA / (Fmax * S1(TR, TO) / 20) \end{aligned}$$

The equation above is solved with TR expressed as function of FMax to give the minimum tool radius required for the tool to remove the material from the workpiece.

The second step in the analysis is to find, at step 303, the minimum radius of curvature of internal corners of the workpiece surface. This step establishes the maximum possible radius of a spherical tool which can treat the entire surface area, i.e. a tool which can enter the internal corners of the workpiece and engage all of the surface. For the example component illustrated in FIG. 3, the radius of the part of the surface area having maximum curvature (i.e. minimum internal radius) will be R1, and thus the largest spherical tool which can treat the entire surface is a tool of radius R1.

The third step 305 is to compare the determined maximum radius of the tool from step 304 with the minimum radius determined in step 302. If the maximum radius from step 304 is greater than the minimum radius from step 302, then a spherical tool with a radius between these two limits is able to treat the entire surface area without wearing out the tool. There may be one or more "standard" size spherical tools whose radii are within this range.

Internal Edges

At step 306 the minimum angle of the internal edges of the workpiece surface is determined from the CAD data 300.

In this case, the analysis proceeds to step 307 to determine whether a spherical tool T having a radius within this range of radii (preferably one of the "standard" size tools) will be able to treat internal edges of the workpiece, i.e. lines of intersection of adjacent faces of the workpiece where the angle between the faces is less than 180°. The radius of the tool must be such that the tool is able to exert sufficient pressure on the surface, or generate sufficient offset, to treat the surface at the edge without exceeding the maximum permitted pressure or offset at areas adjacent the edge.

FIGS. 4*a* to 4*c* are schematic side views of a spherical polishing tool approaching an internal corner or edge E in a workpiece formed at the intersection of two flat faces F1 and F2 of the workpiece. In FIG. 4*a*, the spherical polishing tool T is positioned with an "offset" Ir so as to produce the required pressure on the workpiece, and this produces a generally circular treatment footprint of diameter Df on the flat face F1 of the workpiece. As the footprint of the tool T passes the edge E the tool offset at the edge E as seen in FIG. 4*b* is initially less than the offset Ir required to treat the surface. However, if the offset at the edge E is arranged so as to equal the required offset Ir, as seen in FIG. 4*c*, then the offset at areas adjacent the edge E will exceed the required offset Ir. This may result in offsets >Imax at these areas which exceed the maximum permitted offset and result in excessive tool pressure at these areas.

The processing algorithm preferably tests first the "standard" tool sizes within the range at step 307, and selects the larger or largest radius tool from the successful candidates, i.e. the largest tool which can treat the internal edge E without exceeding the maximum permitted offset Imax. If all of the "standard" tool sizes within the range are too large to successfully treat the internal edges of the workpiece, the processing algorithm then determines whether a spherical tool with a radius at the lower limit of the range will be able to treat the internal edges. If it can, the processing algorithm may then iteratively proceed to determine the largest-radius spherical tool in the size range which can treat the internal edges of the workpiece. At step 307 the surface data analyser then provides to the tool form generator data identifying the largest-radius spherical tool which satisfies the criteria of treating the internal corners and the internal edges of the workpiece, and is large enough to treat the entire workpiece area without wearing out the tool.

If the comparison in step 305 determines that the maximum radius from step 304 (the maximum radius for a spherical tool which will treat the internal curves of the workpiece) is less than the minimum radius from step 302 (the minimum size spherical tool which will be able to complete the shaping process), then the largest spherical tool able to treat the internal corners of the workpiece has insufficient working surface area to treat the entire surface area without wearing out the tool. In such a case, the processing proceeds to step 310 as a non-spherical tool is required in order to simultaneously provide sufficient working surface area to treat the entire workpiece and to provide one or more sharply-radiused ridge portions to treat the internal corners of the workpiece. In one embodiment, such a tool has a spherical region of sufficiently large radius to provide sufficient working surface area of the tool, and one or more annular regions or ridges whose tips are of sufficiently small radius to treat the internal corners of the workpiece.

Non-Spherical Tool

FIGS. 5*a* and 5*b* show examples of non-spherical tools, in diametral section. In FIG. 5*a*, the tool comprises a spindle 52 on which the tool head is mounted. The tool head is axisymmetrical about the axis of the spindle 52, and has a working surface which includes a generally hemispherical working surface portion 51, a generally conical working surface portion 52, and a generally flat working surface portion 53 surrounding the tool spindle. The conical portion 52 meets the hemispherical portion 51 in first annular ridge 54, and the conical portion 52 meets the flat portion 51 in a second annular ridge 55.

FIG. 5*b* shows an alternative form of non-spherical tool. In the tool of FIG. 5*b*, the tool has a part-spherical region 56 which subtends an angle a at the centre of the sphere. The part spherical surface 56 is blended into a conical surface part 57, and the working surface is then rounded at a radiussed ridge 59 where the conical surface 57 meets a conical surface 58 which converges towards a flat top surface of the tool surrounding the tool spindle. The radius of the tip of the ridge 59 is substantially less than the radius of the part-spherical portion 56.

In both of the non-spherical tools illustrated, the ridges 54, 55 and 59 are used to treat internal corners and/or edges of the workpiece which the part-spherical regions 51 and 56 are unable to effectively process. The tool is held against the workpiece at an appropriate orientation such that the ridges 54, 55 or 59 can engage with the internal edges and/or corners of the workpiece in order to treat these parts. For the flatter areas of the workpiece surface which require treatment, the tool is held so that the part-spherical surface 51 or 56 engages the workpiece surface.

The tools are formed from resilient material such as rubber or synthetic elastomers, and in some embodiments the working surfaces of the tools are covered with an array of substantially rigid pellets in which abrasive material is embedded. Such pelleted tools can be used without the need for an abrasive slurry in conjunction with the tool. In other embodiments, the working surface of the tool is the rubber or synthetic elastomer material of the tool, and the tool is used in conjunction with an abrasive slurry The profile of the tool, for example the extent of the part-spherical portion of the tool which is determined by the angle a subtended at the centre by the part-spherical portion of the tool, may be selected on the basis of data correlating surface curvature with the area of the surface having that curvature. This data may be presented in the form of a histogram such as is seen in FIG. 4*a*.

FIG. 4*d* is a histogram representing the surface of the sample component of FIG. 3. The area to be treated which has the radius R1 is the smallest homogeneous area, and the blended corners of radius R2 have a slightly greater area. The largest area to be treated comprises the flat surfaces of the sidewalls 37 to 40 and the base 36 of the recess, which are indicated in the histogram as R3. The area with the most common curvature is R3, and thus the tool will be designed so that its part-spherical surface will polish the area R3, while the tool also has a portion of external radius R1 to treat the smallest-radius areas of the workpiece.

The total areas of the parts R1, R2 and R3 of the component surface are added together to determine the amount of area to be treated, and this establishes the minimum radius of a spherical tool able to treat the workpiece, on the basis of the available working surface area of the tool.

For a non-spherical tool, the angle a which determines how much of the tool surface is part-spherical depends on the ratio of the total area in the histogram which is above the minimum tool radius, to the total area in the histogram which is below the minimum tool radius. In the present example, this ratio is expressed as:

$$R3:(R1+R2)$$

The value of "a" should be such that the proportion of tool surface area that is spherical is the same as the proportion of workpiece surface area that will be polished by this spherical part of the tool. For example, if the spherical part of the tool is to be used to treat half of the workpiece surface area, then the value of a should be set so that half of the working surface of the tool is spherical in form. If most of the area to be treated is flat, then the angle a is larger, to provide a large part-spherical tool working surface for treating the flat areas. If most of the area to be treated is comprised of sharp internal corners then the angle a is smaller and the part-spherical portion of the tool is smaller so that all parts of the tool working surface are exposed to substantially equal amounts of wear during the shaping process. This step corresponds to step 309 in FIG. 3*a*, where the distribution of curvature of the workpiece surface is determined.

At step 310 the requirements of the non-spherical tool form are established by determining what proportion of the tool should be spherical in shape, what radius that spherical part should have, and whether the tool requires one or more ridges or edges of small radius in order to treat sharply curved parts of the workpiece. When these requirements are determined, the profile of the tool can be established.

Tool Production

A shaping tool for use in the process of the present invention may comprise a part-spherical resilient surface on which is disposed a flexible sheet bearing an array of substantially rigid pellets in which abrasive material such as diamond is embedded. Typically, the pellets are approximately disc-shaped and the diameter of each pellet is approximately 0.5 mm, and the centres of adjacent pellets are arranged approximately 0.75 mm apart so as to leave a gap of about 0.25 mm between adjacent pellets. The pellets may be of different shapes, such as rectangular, hexagonal or triangular, and may be arranged in different patterns over the working surface of the tool. The pellets on a tool surface may be of several different shapes, and may be arranged in annular regions where each region contains pellets of one or more particular shape.

Examples of abrasive particles used in the pellets are diamond, cubic boron nitride (CBN), alumina and silica. Diamond particles are indicated for shaping hard ceramic materials such as silicon carbide or tungsten carbide. For shaping metals such as steel, CBN particles may be preferred, while for shaping soft materials such as glass then alumina or silica particles may be used. Other abrasive materials may be used as appropriate, for shaping particular workpiece materials. The particle size of the abrasives may be from 1 to 100 μm. Preferably, the particle size of the abrasives is from 3 to 15 μm, and a particle size of 9 μm for a diamond abrasive, held in a nickel or resin pellet matrix, has been found to be particularly effective for shaping silicon carbide.

It is however also possible to use a resilient tool with a smooth surface, in combination with a grinding slurry. The grinding slurry may contain abrasive particles of from 1 to 9 μm in diameter, suspended in an aqueous medium. The abrasive particles may be of cerium oxide, aluminium oxide or diamond, or any other suitable abrasive material appropriate to the material of the workpiece being shaped.

Manufacture

FIGS. 5*c* to 5*f* illustrate stages in the manufacture of a bespoke tool from a tool blank 500. The tool blank 500 comprises a tool spindle 501, on one end of which is formed an elastomer block 502, formed from a resilient material such as polyurethane, natural or synthetic rubber, nitrile rubber or silicone. When the profile 503 for the tool has been established by the tool form generator, the tool spindle 501 is held for example in a lathe (not shown) and rotated. A shaping tool 504 is applied to the elastomer block 502 to form the block into a tool 505 having the required axisymmetric profile coaxial with the spindle 501. The elastomer block 502 may be a homogenous block of elastomer material, preferably with a hardness on the Shore A scale of between about 40 and 90, preferably about 60.

The shaped tool may be used to shape the workpiece by applying the tool to the workpiece surface in combination with an abrasive slurry.

In particularly advantageous embodiments, the working surface of the tool is covered with a flexible sheet of material carrying a number of rigid pellets, the pellets containing abrasive particles. To form the working surface of the tool, a suitable shape is cut from a sheet 60 of pelleted material. The shape may have a generally circular central area 506 and a number of lobes or "petals" 507 radiating out from the central area 506, the shape and dimensions of the central area 506 and the petals 507 being such that they can be wrapped around the profiled tool 505 to cover or substantially cover its working surface. Other shapes are possible for the pelleted sheet, provided that they can be folded to cover the working surface of the tool. For example, if the tool simply has a part-spherical working surface which subtends a small angle a at the centre of the sphere, then a circular shape without "petals" may be suitable.

Figure 5F:
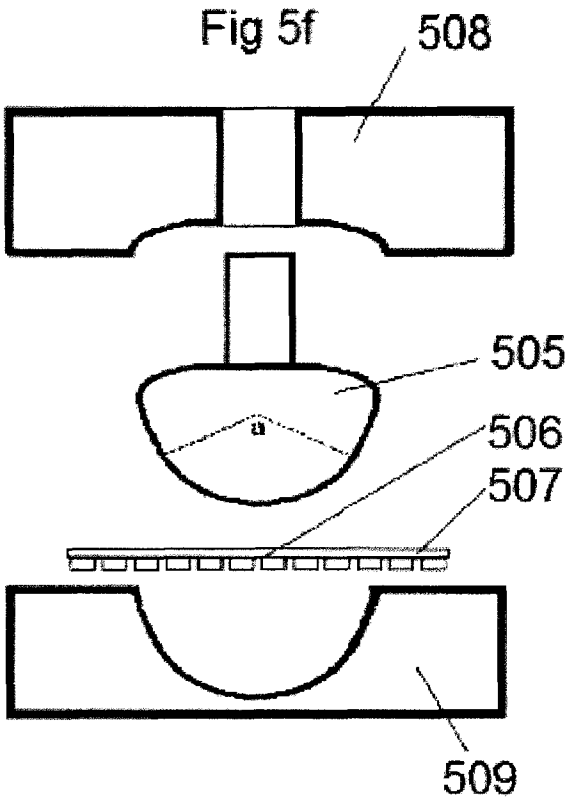
Figure 5G:
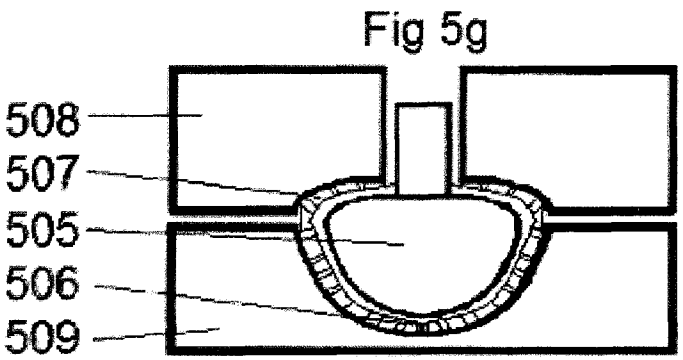
Figure 5D:
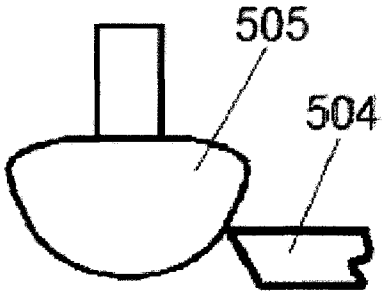
Figure 5C:
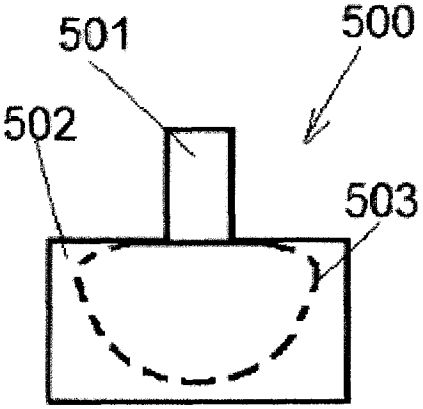
Figure 5E:
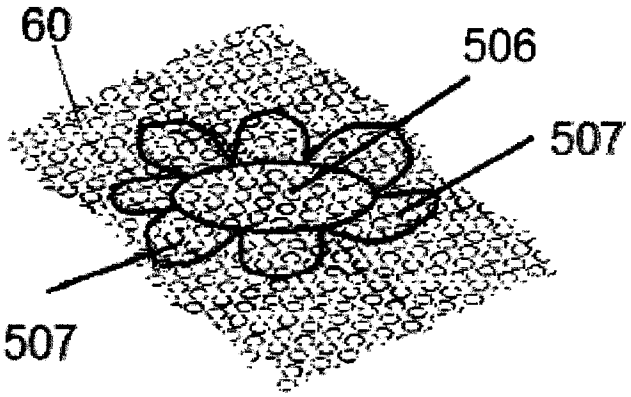

The cut sheet of pelleted material and the tool 505 are then placed between two mould halves 508 and 509 as seen in FIGS. 5*f* and 5*g*, and vulcanised together under heat and pressure to bond or vulcanised the sheet S to the surface of the tool 505 and form a pelleted tool. The sheet 60 of pelleted material may be firstly laid over the cavity in the lower half 509 of the mould, and pushed into the cavity using the tool 505. The petals 507 may then be folded over the upper part of the tool 505 and temporarily secured in place, while the upper half 508 of the mould is brought down to close the cavity. Alternatively, the shaping of the upper mould half may be such that the closing movement of the mould causes the petals 507 to assume their correct positions within the mould. Heat and pressure are then applied to vulcanise the tool and to bond the cut sheet 60 thereto. For example, the mould may be heated to about 150° C. or up to about 200° C. or more, and the tool may be held in the mould for up to 10 minutes.

The tool is then released from the mould, and checked to ensure that the pelleted working surface conforms to the required surface profile of the tool. A further shaping or dressing step may be required to ensure that the tool conforms to the required shape, for example by removing some material from the pellets using a grinding wheel or other shaping tool.

For both pelleted and non-pelleted tools, a tool identification code can then be applied to the tool, this code optionally also including information regarding a nominal tool size, a preferred precession angle for operating the tool, maximum expected tool life and maximum tool offset in use, as well as any other relevant information for the user such as whether the tool is required to be used with or without a grinding slurry, and the preferred characteristics of such a grinding slurry.

Tool Conditioning

In order to prepare the pelleted tool for use, it is necessary to condition the working surfaces of the pellets. The conditioning cycle may be performed after the tool has been produced, by rotating and manipulating the tool while pressing it against a conditioning surface, so that each part of the working surface of the tool contacts the conditioning surface for a time sufficient to alter the working surfaces of the pellets until the surface structure of the pellets stabilises, and the rate at which material is removed from the conditioning surface becomes substantially constant.

Alternatively, the flexible sheet may be conditioned prior to cutting the sheet 60 to the required shape for applying to the tool during manufacture. The uncut sheet may be conditioned as illustrated in FIG. 6*a*, by mounting a sheet 60 of the pelleted material on a supporting surface 61, and then pressing a conditioning "puck" 62 into contact with the sheet and moving the puck 62 over the area of the sheet 60 to condition the exposed surfaces of the pellets. The supporting surface 61 may be static, and the puck 62 may be moved relative to the supporting surface 61 and the sheet 60. Alternatively or additionally, the supporting surface 61 may be movable and/or rotatable to move the sheet 60 relative to the puck 62. The lateral drag force exerted on the puck 62 by the sheet 60 may be measured by a measuring device (not shown) as the conditioning process progresses, and will decrease from a higher initial value eventually to level out at a substantially constant value. The conditioning process is deemed to be completed when this substantially constant value is reached, and can be controlled by measuring the drag force and determining that the conditioning process is completed when the drag force ceases to vary with time.

FIG. 6*b* illustrates an alternative arrangement for conditioning the flexible sheet. In this arrangement, the flexible sheet 60 is formed into an endless belt, and is looped over a pair of rollers 63 and 64 with the pelleted side of the sheet facing outwards. A supporting surface 65 is arranged on the inner side of one run of the belt, and a conditioning block 66 is pressed against the outer, pelleted side of that run of the belt. Rollers 63 and 64 are then rotated to move the belt 60 between the supporting surface 65 and the conditioning block 66, so that the pellets engage with and move relative to the conditioning block 66. Again, the lateral force produced on the conditioning block 66 by the pellets on the sheet 60 may be measured, and conditioning may be considered to be complete when this force reaches a constant value.

The conditioning operation may take up to 15 or 30 minutes, or possibly longer. As an alternative to measuring lateral force on the puck 62 or conditioning block 66, the rate at which material is removed from the puck 62 or the conditioning block 66 may be measured at intervals during the conditioning cycle, and the conditioning cycle may be terminated when the removal rate becomes stable.

The pre-conditioned sheets or belts of mesh may then be cut into the required shape to cover a tool body, for example by stamping the mesh sheets in a die or by cutting the sheets using any suitable cutting tool or means.

The pre-conditioned cut mesh sheet may then be applied to the tool, for example by placing the mesh sheets into a mould, introducing the tool into the mould and vulcanising the tool and mesh together as described in relation to FIG. 5. A further short conditioning step may be applied when the finished tool is removed from the mould, by pressing the tool against a conditioning surface and rotating the tool to expose all parts of the tool surface to the conditioning surface in order to complete the conditioning process.

The objective of the conditioning process is to shape the abrasive particles in the pellets so that they have a flattened exposed surface and a slightly tilted attitude, with a debris pocket at the front and binder up-stand at the back.

Structure of Conditioned Tool

FIG. 7*a* is a micrograph photograph of part of the surface of a conditioned pellet, showing a diamond particle 70 which has been conditioned by moving a conditioning surface relative to the diamond in the direction shown in the arrow of FIG. 7*a*. The conditioning surface is moved upwards and to the right as seen in the figure, and the leading edge of the diamond particle extends upward and to the left, substantially at right angles to the arrow A. The diamond particle 70 has an exposed edge 71. In the sectional view seen in FIG. 7*b*, the diamond particle 70 is seen embedded in the material 72 forming the pellet. The conditioning puck or block is shown as reference numeral 66, and moves relative to the diamond particle 70 in the direction of arrow A, which is roughly perpendicular to the line of the exposed edge 71. In this context, the "front" of the diamond is its leading edge 71 when considered in the direction it will travel across the workpiece when the tool is rotated and contacted to the workpiece. The debris pocket 73 situated adjacent the edge 71 of the diamond particle 70 and illustrated in FIG. 7*b*, is the substantially triangular area seen to the left of the edge 71 in FIG. 7*a*. The exposed surface 74 of the diamond particle 70 is seen in FIG. 7*b* and is slightly tilted at an angle b to the surface of the pellet material 72. In the conditioned tool, the "nodular" form of the surface of the pellets is reduced and smoothed, and exposed abrasive particles are flattened.

Control to Ensure Ductile Grinding

FIG. 8 is a schematic side view of the tool as it moves in contact with the free-form workpiece surface. The body of the tool 81 is moved toward the workpiece surface S until the pellets 84 contact the workpiece surface, and is then moved further towards the workpiece surface by an "offset" amount such that the elastic membrane 82 deforms, pressing the pellets 84 flat onto the workpiece surface S and creating a generally circular tool footprint Fp where the tool surface is in contact with the workpiece surface. The tool body 81 is then rotated about the spindle axis H, which is set at a precession angle P relative to the local normal N to the workpiece surface S, so that the pellets 84 in an annular region of the tool contact the workpiece surface S, in the tool footprint, and move across the workpiece surface. As will be appreciated from FIG. 8, lifting the tool body 81 vertically (as seen in the Figure) will reduce the "offset" Ir, reducing the deformation of the cup 82 and decreasing the diameter of the tool footprint on the workpiece surface S.

For a fluid-filled tool, holding the tool in the same position relative to the workpiece, and increasing the fluid pressure within the tool, results in the pellets 84 being pressed against the workpiece surface S with increased force, but does not increase the area of the tool footprint. For a solid tool made from elastic material, increasing the offset Ir not only increases the area of the tool footprint in contact with the workpiece surface, but also increases the force with which the pellets are pressed against the workpiece surface.

During the shaping operation, the tool is moved in translation over the workpiece surface at a controlled "feed" speed of from 10 to 1000 mm/minute, preferably about 150 mm/minute. The tool is rotated about the spindle axis H at between about 50 and 1500 rpm.

During movement of the tool over the workpiece, the size of the tool footprint is varied by adjusting the "offset" distance Ir between the surface of the workpiece and the centre of the part-spherical surface of the tool. The force with which the tool is pressed against the workpiece is either controlled by controlling the fluid pressure inside the cup of the tool, or by adjusting the offset. The tool rotation speed and the angle P and direction of the precession axis are also controlled, and in conjunction with the tool footprint Fp and pressure determine the instantaneous rate at which material is removed from the workpiece at any point along the tool path. By controlling the tool "feed" speed, the time which the tool spends at each point along the tool path is controlled and thus the amount of material removed from each point along the tool path is determined.

Control of the direction of the precession axis determines the relative direction of movement of the tool to the workpiece at each point on the tool path. The control of the instantaneous direction in which the pellets move over the surface may be effected with the objective that polishing artefacts (grooves, ridges) are not left in the workpiece surface, for example by continuously varying the direction of relative movement of the pellets and the workpiece. Alternatively, the direction of movement of the pellets over the surface may be controlled such that any polishing marks left on the surface are aligned in a particular direction or directions. The "feed" speed at which the tool moves along the tool path is also controlled, to ensure that the required amount of material is removed at each point along the path, and the required surface finish is achieved.

Determining Tool Offset

As the pressure exerted by the abrasive particles on the workpiece increases, the cutting regime of the particles changes from a ductile regime in which material is removed with minimal cracking and sub-surface damage to the workpiece, to a "brittle" cutting regime in which surface cracks and sub-surface damage appear.

A method for determining the maximum possible offset which maintains a ductile cutting regime is illustrated in FIG. 9. FIG. 9*a* is a schematic illustration of the testing method, which involves moving the tool across a test surface without rotating the tool about its precession axis H, while continuously increasing the offset Ir. The test may be carried out on a dedicated test apparatus, or may be carried out by mounting the workpiece in a shaping machine and moving the tool over the workpiece surface. In the illustrated test process, the tool is moved along a flat surface by a distance of 25 mm, while the tool offset is increased from 0 to 0.4 mm. The test surface is preferably made from the same material as the workpiece which is to be shaped, or may be a part of the workpiece to be shaped.

This test method is suitable both for pelleted tools and for tools shaped from an elastomer blank. For pelleted tools, the test is carried out after conditioning of the tool. For non-pelleted tools, the test is carried out by firstly pressing the tool into dry abrasive powder to embed abrasive particles into the surface of the tool, and the tool is then drawn across the test surface as the tool offset is increased. The analysis of the results is the same in both cases.

FIG. 9B illustrates the pattern of scratches formed on the test surface by the abrasive particles in the pellets of an elastic tool. At the left-hand side of the figure, there are few scratches since the tool footprint is minimal due to the zero offset. As the tool is moved across the test surface, the increasing offset not only increases the pressure of the tool surface against the workpiece, but also increases the size of the tool footprint and brings more abrasive particles into contact with the test surface, resulting in a larger number of scratches. At the right-hand end of the illustration, where the tool footprint is largest, the largest number of scratches is seen. The depth of the scratches increases progressively from left to right as seen in the Figure, as the pressure against the workpiece increases.

FIGS. 9*c* to 9*f* are enlarged schematic views showing the surface structures of the respective areas c, d, e and f illustrated in FIG. 9*b*. The indentations or scratches 91 produced by the abrasive particles moving over the test surface have, in the area c, predominantly smooth walls. As the test movement progresses, the walls of the indentations become progressively more fractured. The fracturing of the walls is illustrated schematically by the irregular patches 92. The enlarged detail in FIG. 9*f* shows the scratch 91 with a smooth wall profile, which becomes irregular in the patch 92. A ductile to brittle transition is identified as the point at which the walls of the indentations are irregular (fractured) for more than a threshold amount, for example 10%, of the length of the test sample considered. In the section of scratch shown in the enlarged detail of FIG. 9*f*, lengths L1 and L3 have smooth walls indicate of ductile cutting, whereas the length L2 has irregular fractured walls indicative of brittle cutting. By calculating the percentage L2/(L1+L3), and comparing this to the 10% threshold, it is determined whether predominantly brittle or ductile cutting is occurring at this point.

FIG. 10 illustrates the relationship between tool offset and the percentage of fractured walls of the indentations for a silicon carbide test sample. At tool offsets from 0 to about 0.125, the percentage of fractured walls is initially zero, and rises slowly to approximately 10% in this test sample. The percentage of fractured walls then rises rapidly, reaching 90% fractured at an offset of 0.215. Thereafter, the percentage of fractured walls levels off at about 95% for offsets greater than 0.25.

By inspecting the walls of the indentations to determine how much of the indentations are fractured, and correlating this measurement with the amount of offset applied to the tool at the point where the indentations were made, the amount of offset Imax which results in the threshold percentage of fracturing of the walls of the indentations can be determined. This inspection may be carried out by capturing images of the indentations, and using image processing to analyse the edges of the indentations and calculate the percentage of the edges which are smooth and linear, and the percentage which are fractured and irregular. By taking such measurements at various locations along the test path, and correlating the measurements with the amount of offset at each location, a test processor can establish the relationship between the amount of offset and the percentage of fractured edges, and can establish the amount of offset at which the cutting regime changes from ductile cutting to brittle cutting as the percentage of fractured edges passes a predetermined threshold, for example 10%.

This data is then used in the tool path generation process to ensure that at all points along the tool path this maximum offset Imax is not exceeded and thus the shaping process is carried out with ductile cutting of the workpiece. The tool path may be optimised so that the value of the offset at any point along the tool path is maximised up to the limit of ductile cutting, or alternatively the tool path may be calculated such that the value of the offset does not exceed a particular proportion, for example 80%, of the maximum permissible offset for ductile cutting.

Tool Wear Monitoring

The tool path generator determines the amount of wear dW that the tool will experience when performing this shaping operation. The tool path generator first calculates the total amount of material to be removed from the workpiece and the surface configuration of the tool, based on the measurement data representing the initial form of the workpiece, and the CAD data representing the final form. Using this information and a "Grinding Ratio" which depends on the relative hardnesses of the workpiece and the working surface of the tool, the amount of wear dW that the tool will suffer when performing this shaping operation can be determined. The "Grinding Ratio", i.e. the ratio between material removed from the workpiece and wear of the grinding tool may be determined experimentally for particular tool/workpiece combinations.

Optimising Tool Pressure

With a spherical tool of uniform hardness or elasticity, the pressure exerted by the tool at each point in the footprint varies according to a Hertzian distribution, with maximum pressure at the centre of the footprint. This is illustrated in FIG. 11*a*, which schematically shows a part-spherical resilient tool pressed against a flat surface, with a plot of pressure against radius for the tool footprint shown below the figure. The plot shows that the pressure exerted by the tool is highest at the centre of the tool footprint, where the part-spherical surface is most deformed.

In the shaping process of the present invention, the pressure at each point in the tool footprint should also be such that abrasive particles in the working surface of the tool are pressed against the workpiece surface with a force which results in ductile cutting of the workpiece. The pressure at the centre of the footprint may result in the abrasive particles of the tool being pressed against the surface of the workpiece with sufficient force that brittle grinding takes place, resulting in sub-surface damage.

In order to reliably achieve ductile grinding over the entire area of the tool footprint, the pressure exerted by the tool over the footprint should be as uniform as possible.

In order to provide a more uniform pressure distribution over the tool footprint for a spherical tool, it is proposed to use a tool as illustrated in FIG. 11*b*, in which the tool is not made from a homogeneously resilient material, but has regions of different hardness or elasticity.

In the tool illustrated in FIG. 11*b*, the main body A60 of the tool is produced from material with a Shore A hardness of about 60. Extending around the free end of the tool is a first region A50 generally "L" shaped in cross-section, which has an exposed area near to the tip of the tool, and a second exposed area approximately on the tool shoulder where the part-spherical region meets the main tool body.

Nested within the region A50 is a region A40 also of generally "L" shaped cross-section, and exposed on the surface adjacent the two areas of exposure of the portion A50. Filling the generally "L" shaped profile of the region A40 is a ring of material A30 which is exposed on the surface of the tool as a continuous band.

The ring A30 is formed from a softer material than the region A40, which in turn is softer than the region A50 which in turn is softer than the main body A60 of the tool. In one example, the Shore A hardnesses of the regions A50, A40, and a 30 may be 50, 40 and 30 respectively. The precise positioning of these regions will be such that at the intended precession angle with which the tool is to be used, the softest ring A30 passes across the centre of the tool footprint as the tool rotates relative to the workpiece.

When the tool is inclined so that the exposed part of region A30 extends across the centre of the tool footprint, the pressure at the centre of the footprint is reduced, due to the softness of the material, so that a substantially uniform pressure distribution across the entire tool footprint is achieved. This is illustrated in the plot below FIG. 11*b*.

The tool may be spherical or part-spherical, or may have a bespoke profile suited to a particular workpiece. The positions of the regions of differing hardness will depend on the intended precession angle of the tool. The regions may be produced by inlaying toroidal regions of material of different hardnesses within the spherical outline of the tool.

Alternatively, the tool may be produced by assembling concentric cylinders of materials of different hardnesses to form a tool blank from which the tool profile may be machined, as illustrated in FIG. 11*c*. This tool is formed from a central core 110 surrounded by four sleeves 111, 112, 113 and 114 of resilient material of different hardnesses. The central core 110 and the outermost sleeve 114 are of relatively harder material, the intermediate sleeves 111 and 113 respectively adjacent to the central core 110 and the outermost sleeve hundred and 14 are made of a softer material, and the sleeve 112 situated between the intermediate sleeves 111 and 113 is of a softer material still. For example, the central core 110 and the outermost sleeve 114 are formed from a material of Shore A hardness 60, the intermediate sleeves 111 and 113 are formed from a material of Shore A hardness 50, and the sleeve 112 is formed from a material of Shore A hardness 40. The dimensions of the sleeves are arranged so that the softest material is exposed on the part-spherical surface of the tool at a point which coincides with the centre of the tool footprint when the tool is operated at the design precession angle. When the tool is pressed against a workpiece, the central areas of the tool footprint are the most deformed parts of the tool, but since these are formed from the softest material the pressure generated on the workpiece is substantially constant over the tool footprint In a further alternative, the tool may be formed by a 3-D printing technique using different hardnesses of material for the different regions of the tool.

In a further alternative embodiment the tool may have a contoured supporting core over which varying depths of rubber are deposited to form a spherical tool surface, the differing depths of rubber between the core and the workpiece, as measured in radial directions of the spherical tool, producing a substantially constant contact pressure over the tool footprint at the design precession angle.

A shaping machine for shaping a workpiece using the tools and methods of the present invention is illustrated in FIGS. 12*a* to 12*d*.

The shaping machine 1200 comprises a robust table 1201 resistant to vibrations. On the table 1201 there is mounted an X-slide mechanism 1202 for movement in the x direction. On the X-slide mechanism 1202 there is mounted a Y-slide mechanism 1203 for movement in the y direction. On the Y-slide mechanism 1203 there is mounted a turntable 1204 for rotation about the axis labelled c. The turntable 1204 is mounted on the Y-slide mechanism 1203 via a z movement mechanism (not shown) for movement of the turntable 1204 in the z direction. The turntable 1204 has a holding surface onto which a workpiece 1205 may be mounted for shaping and/or finishing. This arrangement provides for motion of the workpiece 1205 in four axes, namely linear movement in the x, y and z directions, and rotation about the c axis. It will be appreciated that in the arrangement shown, the rotation axis c is parallel to the movement axis z.

Also mounted to the table 1201 is a tool support arm 1206 which is generally "L" shaped, having a generally horizontal base part 1206*a* and a generally vertical upright 1206*b*.

The tool support arm is mounted to the table 1201 at the end of the base part 1206*a* remote from the upright 1206*b* for rotation about a vertical axis A. At the upper end of the upright 1206*b* a tool holder 1207 is mounted to the upright, so as to be rotatable relative to the upright about horizontal axis B. In the tool holder 1207, a rotary tool 1208 is mounted for rotation relative to the tool holder, about an axis H which is set at an angle to the axis B about which the tool holder 1207 rotates relative to the upright 1206*b*.

The rotary tool 1208 has a part-spherical working surface, which is arranged so that the rotation axes A, B and H coincide at the centre of the part-spherical surface. The arrangement is such that rotation of the tool arm 1206 about the axis A rotates the part-spherical surface without moving the tool in translation, and rotation of the tool holder 1207 about the axis H likewise does not move the tool in translation but merely alters the plane of the precession angle between the tool rotation axis B and the tool holder axis H.

Control of the movement of the workpiece in the x, y and z directions and rotation about the c axis, and control of the rotations of the tool arm 1206, the tool holder 1207 and the tool 1208 are affected by actuators and drives controlled by a processor apparatus 1209. The processor apparatus 1209 may include input means 1210 such as a keyboard, a port for external input signals or a disk drive, to receive process parameters and control instructions for controlling the motions of the workpiece and the tool. A display means 1211 may be provided to display information to the machine operator.

In operation, the shaping machine 1200 shapes the workpiece, using the determined tool path from the tool path generator 14 in combination with the selected or manufactured tool. The processor apparatus 1209 receives the tool path data from the tool path generator 14, the selected or manufactured tool 1208 is mounted in the tool holder 1207, and the processor apparatus 1209 controls the shaping machine 1200 to move the tool 1208 along the tool path relative to the workpiece in accordance with the tool path data.

The shaping machine 1200 may include a sensor to detect an identifying component and/or marking on the tool 1208, the sensor providing an output to the processor apparatus 1209 to ensure that the correct tool path is used to control movement of the tool 1208. The sensor may be an RFID sensor and the identifying component may be an RFID tag, or the sensor may be an optical detector to detect a marking such as a barcode or a QR code marked on the tool.

The tool path data received from the tool path generator 14 may include data identifying the tool to be used, and also may include data identifying the workpiece. The workpiece may be marked with an identifying tag such as a barcode or an RFID tag, which is readable by the or a sensor associated with the shaping machine 1200. The processor apparatus 1209 may be arranged so that the shaping operation can only take place if the identifying data of the tool and the workpiece coincides with identifying data received from the tool path generator 14. This will ensure that the correct tool, and tool path data, are used to shape the workpiece for which the tool path data has been calculated.

The invention claimed is:

1. A method of shaping a region of a surface of a workpiece comprising the steps of:

measuring the workpiece surface to obtain measurement data of the region to be shaped;

comparing the obtained measurement data with data representing a required surface form of the said region of the workpiece surface, to determine an amount and distribution of material to be removed;

analysing the data representing the required surface form of the workpiece to determine form characteristics of the region to be shaped;

providing a shaping tool of a size and form which can treat all parts of the region to be shaped on the basis of the determined form characteristics;

determining a tool path for moving the shaping tool over the region to be shaped in order to remove the material from the surface, wherein the tool path defines a tool offset at all points along the tool path, the tool offset being the amount of a deformation of the shaping tool against the workpiece surface; and shaping the workpiece by mounting a shaping tool having the determined size and form in a fixture, and moving the shaping tool over the said region of the workpiece surface using the determined tool path in order to remove the material from the workpiece surface, wherein the tool offset at all points along the tool path does not exceed a maximum tool offset and wherein the maximum tool offset is such that the shaping of the workpiece remains within a ductile regime at all points along the tool path;

wherein either: the shaping tool has an abrasive working surface or, during shaping of the workpiece, an abrasive slurry is provided between the shaping tool and the workpiece.

2. A method according to claim 1 in which the step of providing the shaping tool comprises selecting a shaping tool from a plurality of shaping tools.

3. A method according to claim 1 in which the step of providing a shaping tool comprises manufacturing, from a tool blank, a shaping tool having a size and form which can treat all parts of the region to be shaped.

4. A method according to claim 1, further including:

maintaining a database storing, for a plurality of shaping tools, identity data, shape information, current wear amount and total wear amount sustainable by each tool;

analysing the determined amount and distribution of material to be removed, to determine an amount of wear which will be caused to the shaping tool by performing the shaping operation;

determining a minimum surface area for the shaping tool to sustain the determined amount of wear; and determining a size for the shaping tool based on the determined minimum surface area.

5. A method according to claim 4 wherein, after a shaping tool has completed a shaping operation, the database is updated to add the determined amount of wear to the current wear amount stored for that shaping tool.

6. A method according to claim 4, including the step of comparing a sum of the determined amount of wear and the current wear amount of the shaping tool to the total wear amount of the shaping tool; and if the sum exceeds the total wear amount, selecting or manufacturing an alternative tool.

7. A method according to claim 1 including the step of:

simulating movement of the shaping tool over the workpiece using the tool path in order to detect any collision between a tool fixture and workpiece, and recalculating the tool path if a collision occurs.

8. Apparatus for shaping a workpiece, comprising:

one or more databases configured to store:

measurement data of a region of the workpiece to be shaped; data representing a required surface form of the said region of the workpiece surface;

a processor means for:

determining an amount and distribution of material to be removed, on the basis of the obtained measurement data and the data representing the required surface form;

analysing the data representing the required surface form of the workpiece to determine form characteristics of the region to be shaped;

determining a size and form of a shaping tool which can treat all parts of the region to be shaped on the basis of the determined form characteristics; and determining a tool path for moving the shaping tool over the region to be shaped in order to remove the material from the surface, wherein the tool path defines a tool offset at all points along the tool path, the tool offset being the amount of a deformation of the shaping tool against the workpiece surface, wherein the tool offset at all points along the tool path does not exceed a maximum tool offset and wherein the maximum tool offset is such that the shaping of the workpiece remains within a ductile regime at all points along the tool path;

the apparatus further comprising:

a means for providing a shaping tool having the determined size and form;

a shaping machine including a fixture for mounting the shaping tool, the shaping machine further comprising a control means for controlling the fixture to move the shaping tool over the said region of the workpiece surface using the determined tool path in order to remove the material from the workpiece surface;

wherein either: the shaping tool has an abrasive working surface or the apparatus is configured to provide, during shaping of the workpiece, an abrasive slurry between the shaping tool and the workpiece.

9. Apparatus according to claim 8, wherein the means for providing a shaping tool comprises:

a plurality of shaping tools; and a selection means for selecting one of said plurality of shaping tools.

10. Apparatus according to claim 8, wherein the means for providing a shaping tool comprises a means to manufacture a shaping tool of the determined size and form.

11. A system for shaping a workpiece, comprising:

a plurality of shaping tools;

a shaping machine for moving a shaping tool along a tool path over a workpiece;

a measuring means to generate data representing an actual shape of the workpiece;

one or more databases configured to store:

data representing the actual shape of the workpiece;

data representing a required shape of the workpiece;

identity, form and wear data relating to each of the said plurality of shaping tools;

a processor means for:

determining a required form of a shaping tool on the basis of the data representing the required shape of the workpiece;

selecting from said plurality of shaping tools a shaping tool which has the required form for shaping the workpiece;

determining an amount and distribution of material to be removed from the workpiece on the basis of the data representing the actual shape and the data representing the required shape of the workpiece;

determining a tool path for moving the selected shaping tool over the workpiece in a shaping operation to remove the said material from the workpiece;

wherein the selected shaping tool and data representing the determined tool path are provided to the shaping machine; and the shaping machine is operable to shape the workpiece by moving the selected shaping tool over the workpiece surface along the determined tool path.

12. A system according to claim 11, wherein:

the stored wear data relating to each of the said plurality of shaping tools includes a current wear amount and a maximum wear amount, and the processor means is further operable to:

determine an expected amount of wear on the tool consequent to performing the shaping operation;

compare a sum of the expected amount of wear and the current wear amount of the selected tool with the maximum wear amount for the selected tool; and if the sum exceeds the maximum wear amount then select an alternative tool.

* * * * *